US008333823B2

(12) United States Patent
Iwasaki et al.

(10) Patent No.: US 8,333,823 B2
(45) Date of Patent: Dec. 18, 2012

(54) METHOD AND SYSTEM FOR PRODUCING METALLIC IRON NUGGETS

(75) Inventors: Iwao Iwasaki, Grand Rapids, MN (US); Richard F. Kiesel, Hibbing, MN (US); David J. Englund, Bovey, MN (US); Dave Hendrickson, Coleraine, MN (US)

(73) Assignee: Nu-Iron Technology, LLC, Charlotte, NC (US)

( * ) Notice: Subject to any disclaimer, the term of this patent is extended or adjusted under 35 U.S.C. 154(b) by 0 days.

(21) Appl. No.: 12/847,591

(22) Filed: Jul. 30, 2010

(65) Prior Publication Data

US 2011/0100162 A1 May 5, 2011

Related U.S. Application Data

(63) Continuation of application No. PCT/US2009/032519, filed on Jan. 30, 2009.

(60) Provisional application No. 61/024,861, filed on Jan. 30, 2008.

(51) Int. Cl.
*C22B 1/16* (2006.01)
*C22B 1/24* (2006.01)
*C22B 11/08* (2006.01)

(52) U.S. Cl. ..... 75/484; 75/504

(58) Field of Classification Search ..... 75/484, 75/504

See application file for complete search history.

(56) References Cited

U.S. PATENT DOCUMENTS

| | | | | |
|---|---|---|---|---|
| 6,126,718 | A | 10/2000 | Sawa et al. | |
| 6,270,552 | B1 | 8/2001 | Takeda et al. | |
| 6,413,295 | B2 | 7/2002 | Meissner et al. | |
| 6,592,649 | B2 * | 7/2003 | Kikuchi et al. | 75/504 |
| 6,648,942 | B2 | 11/2003 | Hoffman et al. | |
| 2010/0107818 | A1 * | 5/2010 | Bleifuss et al. | 75/436 |
| 2010/0164150 | A1 * | 7/2010 | Iwasaki et al. | 266/216 |

FOREIGN PATENT DOCUMENTS

| | | | |
|---|---|---|---|
| EP | 0 947 586 | A1 | 10/1999 |
| EP | 1 808 498 | A1 | 7/2007 |
| JP | 11-106816 | A | 4/1999 |
| JP | 2002 129218 | A | 5/2002 |
| WO | 00/56941 | A1 | 9/2000 |
| WO | 2009105320 | | 8/2009 |

OTHER PUBLICATIONS

International Search Report for PCT/US2009/032519, dated Sep. 7, 2009.

* cited by examiner

*Primary Examiner* — George Wyszomierski
*Assistant Examiner* — Tima M McGuthry Banks
(74) *Attorney, Agent, or Firm* — Hahn, Loeser & Parks LLP; Arland T. Stein

(57) ABSTRACT

A method and system for producing metallic iron nuggets may include providing multiple layers of agglomerates, such as briquettes, balls and extrusions, of a reducible mixture of reducing material (such as carbonaceous material) and of a reducible iron bearing material (such as iron oxide) on a hearth material layer (such as carbonaceous material) and providing a coarse overlayer of carbonaceous material over at least some of the agglomerates. Heating the agglomerates of reducible mixture to 1425° C. or 1400° C. or 1375° C. results in formation of an intermediate product of one or more metallic iron nuggets, which may have a sulfur content of less than 0.03%, and slag, which may have less than 5% mass MgO, which may have a ratio of percent by weight sulfur in the slag over percent by weight sulfur in the metallic nuggets of at least about 12 or at least about 15.

74 Claims, 30 Drawing Sheets

| | $SiO_2$ | $Al_2O_3$ | CaO | MgO | Fe | S | LOI |
|---|---|---|---|---|---|---|---|
| $Al(OH)_3$ I | --- | 29.94 | --- | --- | --- | --- | --- |
| $Al(OH)_3$ II | --- | 55.90 | --- | --- | --- | --- | --- |
| Bauxite | 2.53 | 57.35 | 0.09 | 0.04 | 7.2 | --- | --- |
| Bentonite | 63.46 | 25.70 | 4.53 | 1.40 | 2.26 | --- | --- |
| $Ca(OH)_2$ | --- | --- | 75.7 | --- | --- | --- | --- |
| Lime hydrate | 0.71 | 0.65 | 76.67 | 1.12 | --- | --- | 30.84 |
| Limestone | 0.70 | 0.27 | 47.90 | 0.95 | 0.10 | --- | 43.99 |
| Portland cement | 19.61 | 4.63 | 66.65 | 3.32 | 1.77 | 0.90 | --- |

FIG. 4

| Fluorspar Added, % | Slag Comp. | $L_1$ | | $L_{1.5}$ | | $L_2$ | |
|---|---|---|---|---|---|---|---|
| | | %C | %S | %C | %S | %C | %S |
| 0 | $L_m$ | 2.84 | 0.072 | 2.26 | 0.058 | 2.13 | 0.050 |
| 0.5 | $L_mFS_{0.5}$ | 3.27 | 0.060 | 3.06 | 0.055 | 2.60 | 0.048 |
| 1 | $L_mFS_1$ | 3.36 | 0.058 | 3.63 | 0.041 | 3.25 | 0.038 |
| 2 | $L_mFS_2$ | 3.67 | 0.043 | 3.86 | 0.021 | 3.73 | 0.015 |
| 4 | $L_mFS_4$ | 3.77 | 0.030 | 4.22 | 0.013 | 4.12 | 0.009 |

FIG. 8

| %$CaF_2$ | Slag Comp. | Weight distribution, % | | | |
|---|---|---|---|---|---|
| | | Nuggets | Micro nuggets | -20 mesh mag. | Slag |
| 0 | $L_{0.5}$ | 67.6<br>**89.2*** | 8.2<br>**10.8** | 4.6 | 19.6 |
| 0.25 | $L_{0.5}CF_{0.25}$ | 76.5<br>**98.1** | 1.5<br>**1.9** | 2.5 | 19.5 |
| 0.5 | $L_{0.5}CF_{0.5}$ | 78.1<br>**99.4** | 0.5<br>**0.6** | 1.5 | 19.9 |
| 0.75 | $L_{0.5}CF_{0.75}$ | 76.6<br>**97.9** | 1.7<br>**2.1** | 1.2 | 20.5 |
| 1 | $L_{0.5}CF_1$ | 77.5<br>**98.9** | 0.8<br>**1.1** | 1.7 | 20.0 |
| 1.25 | $L_{0.5}CF_{1.25}$ | 76.6<br>**99.4** | 0.5<br>**0.6** | 1.7 | 21.2 |
| 1.5 | $L_{0.5}CF_{1.5}$ | 75.9<br>**99.1** | 0.7<br>**0.9** | 2.0 | 21.4 |
| 1.75 | $L_{0.5}CF_{1.75}$ | 76.1<br>**99.5** | 0.4<br>**0.5** | 1.2 | 22.3 |
| 2 | $L_{0.5}CF_2$ | 74.8<br>**98.7** | 1.0<br>**1.3** | 1.9 | 22.3 |

* Numbers in bold represent relative amounts of nuggets and micro nuggets.

FIG. 9

| $CaF_2$ added, % | Temp. °C | % micro nuggets generated | | | | |
|---|---|---|---|---|---|---|
| | | L | $L_{0.5}$ | $L_1$* | $L_{1.5}$* | $L_2$* |
| 0 | 1400 | 8.8 | 5.3 , 10.8 | 7.4**, 21.5 | 22.2** | 26.6** |
| 0.5 | | | 0.6 | 1.4 | 0.6 | 1.7 |
| 1 | | 0.5 | 1.1, 1.2 | 0.8 , 0.2 | 0.6 | 0.5 |
| 2 | | | 1.3 | 0.3 | 1.3 | 0.9 |
| 4 | | | | 0.2 | 2.2 | 2.4 |
| 0 | 1350 | | 17.9 | 26.7*** | 16.5*** | —**** |
| 0.5 | | | | 1.4 | 0.7** | 2.2** |
| 1 | | 1.6 | 2.5 , 0.9 | 2.8, 1.4 , 3.9 | 0.6 | 0.4 |
| 2 | | | | 1.3 | 1.1 | 1.4 |
| 4 | | | | 1.6 | 1.8 | 2.6 |
| 0 | 1325 | | | — | — | — |
| 0.5 | | | | — | — | — |
| 1 | | | | 1.2**, 5.5 , 6.0 | 0.6* | 8.7** |
| 2 | | | | 0.4** | 0.7* | 9.5* |
| 4 | | | | 1.4** | 3.1** | 2.2** |

* Fluorspar instead of $CaF_2$ used.
* Nearly fused.
** Not quite fused.
*** Partially fused.
**** Reduced, but not coalesced.

FIG. 10

| $Na_2CO_3$ added, % | Slag Comp. | %S in iron nuggets | | | | |
|---|---|---|---|---|---|---|
| | | L | $L_{0.5}$ | $L_1$** | $L_{1.5}$** | $L_2$** |
| 0* | $L_m$ | 0.084 | 0.081 | 0.072 | 0.058 | 0.050 |
| 2* | $L_mSC_2$ | — | 0.031 | — | — | — |
| 0 | $L_mCF_1$ | 0.083 | 0.074 | 0.064 | 0.041 | 0.038 |
| 0.25 | $L_mCF_1SC_{0.25}$ | 0.069 | 0.053 | 0.045 | — | — |
| 0.5 | $L_mCF_1SC_{0.5}$ | 0.058 | 0.050 | 0.038 | 0.028 | 0.032 |
| 1 | $L_m$ $CF_1SC_1$ | 0.043 | 0.043 | 0.030 | 0.029 | 0.029 |
| 2 | $L_m$ $CF_1SC_2$ | 0.043 | 0.024 | 0.020 | 0.021 | 0.018 |

* No $CaF_2$ added
** Fluorspar instead of chemical $CaF_2$ used.
m % additional lime over Composition L.

FIG. 11

| Temp. °C | %C | %S |
|---|---|---|
| 1400 | 3.25 | 0.029 |
| 1350 | 2.89 | 0.022 |
| 1325* | 2.28 | 0.013 |

* Nearly fused.

FIG. 13

| | LHF 14 | LHF 15 | LHF 17 |
|---|---|---|---|
| (a) Nugget analysis, % | | | |
| C | 2.92 | 2.70 | 3.15 |
| S | 0.203 | 0.266 | 0.152 |
| (b) Slag basicity | | | |
| $CaO/SiO_2$ | 1.48 | 1.53 | 1.71 |
| $\frac{CaO+MgO}{SiO_2+Al2O_3}$ | 1.35 | 1.38 | 1.53 |
| (S)/[S] | 0.64 | 0.64 | 1.40 |
| (c) Slag analysis, %* | | | |
| $Fe_2$ | 6.3 | 6.7 | 6.0 |
| FeO | 6.70 | 7.18 | 6.31 |
| $SiO_2$ | 35.01 | 34.03 | 32.24 |
| $Al_2O_3$ | 5.11 | 5.24 | 5.18 |
| CaO | 51.90 | 52.18 | 55.27 |
| MgO | 2.36 | 2.01 | 1.89 |
| S | 0.129 | 0.169 | 0.213 |

FIG. 15

| Slag comp. (coal, %stoich.) | Nuggets | | Slag | | |
|---|---|---|---|---|---|
| | %C | %S | %Fe | %FeO | %S |
| **LHF 14** (2600°F) | | | | | |
| $L_{1.5}FS_1$ (115%) | 2.92 | 0.203 | 6.3 | 6.70 | 0.129 |
| **LHF 15** (2600°F) | | | | | |
| $L_{1.5}FS_1$ (115%) | 2.70 | 0.266 | 6.7 | 7.18 | 0.169 |
| **LHF 17** (2600°F) | | | | | |
| $L_{1.5}FS_2$ (115%) | 3.15 | 0.152 | 6.0 | 6.31 | 0.213 |
| **LHF 21** (2625°F) | | | | | |
| $L_{1.5}FS_{1.5}$ (115%) | 2.98 | 0.213 | 6.5 | 6.66 | 0.17 |
| $L_{1.5}FS_{1.5}$ (120%) | 3.06 | 0.215 | 6.3 | 6.41 | 0.17 |
| $L_{1.5}FS_2$ (115%) | 3.63 | 0.114 | 3.2 | 2.75 | 0.28 |
| $L_{1.5}FS_2$ (120%) | 3.24 | 0.195 | 4.1 | 3.83 | 0.31 |
| **LHF 22** (2625°F) | | | | | |
| $L_{1.5}FS_1SC_1$(120%) | 3.05 | 0.169 | 4.2 | 4.06 | 0.21 |
| $L_{1.5}FS_2SC_1$(125%) | 3.22 | 0.162 | 2.8 | 2.27 | 0.31 |
| $L_{1.5}FS_2SC_2$(125%) | 3.49 | 0.117 | 3.0 | 2.51 | 0.33 |

FIG. 16

| | Nuggets | | Slag | | |
|---|---|---|---|---|---|
| | %C | %S | %Fe | %FeO | %S |
| **LHF 22** | | | | | |
| (1a) 85% coal 1.0 lb/ft$^2$ cover | 3.68 | 0.027 | 0.10 | 0.21 | 1.03 |
| (2a) 90% coal 1.0 lb/ft$^2$ cover | 3.82 | 0.022 | 0.24 | 0.56 | 0.88 |
| (3a) 95% coal 1.0 lb/ft$^2$ cover | 3.82 | 0.020 | 0.12 | 0.28 | 1.07 |
| (1b) 85% coal 0.5 lb/ft$^2$ cover | 3.67 | 0.040 | 0.09 | 0.21 | 0.97 |
| (2b) 90% coal 0.5 lb/ft$^2$ cover | 3.62 | 0.041 | 0.23 | 0.49 | 0.98 |
| (3b) 95% coal 0.5 lb/ft$^2$ cover | 3.58 | 0.066 | 0.27 | 0.56 | 0.97 |

FIG. 19

| Test No. | Nuggets | Micro nuggets | +20 mesh mag | Slag |
|---|---|---|---|---|
| **LHF 27 (2600 °F)** | | | | |
| (a) 80% coal | 79.6 | 1.9 | 1.8 | 16.7 |
| 1.25 lb/ft$^2$ cover | **97.7** | **2.3** | | |
| (b) 80% coal | 77.3 | 1.5 | 0.7 | 20.5 |
| 1.0 lb/ft$^2$ cover | **98.1** | **1.9** | | |
| (c) 80% coal | 74.9 | 1.5 | 0.6 | 23.0 |
| 0.75 lb/ft$^2$ cover | **98.0** | **2.0** | | |
| **LHF 28 (2550 °F)** | | | | |
| (a) 80% coal | (88.6)** | (1.2) | (2.2) | (8.0) |
| 1.25 lb/ft$^2$ cover | **(98.7)**** | **(1.3)** | | |
| (b) 80% coal | (93.9)** | (1.0) | (2.2) | (2.9) |
| 1.0 lb/ft$^2$ cover | **(98.9)**** | **(1.1)** | | |
| (c) 80% coal | (83.7)** | (1.1) | (1.3) | (13.9) |
| 0.75 lb/ft$^2$ cover | **(98.7)**** | **(1.3)** | | |
| **LHF 29 (2550 °F)** | | | | |
| (1a) 80% coal | 74.9 | 1.1 | 1.4 | 22.6 |
| 1.0 lb/ft$^2$ cover | **98.6** | **1.4** | | |
| (2a) 110% coal | 69.0 | 3.6 | 8.3 | 19.1 |
| 1.0 lb/ft$^2$ cover | **95.0** | **5.0** | | |
| (1b) 80% coal | 77.1 | 0.4 | 0.8 | 21.7 |
| 0.75 lb/ft$^2$ cover | **99.5** | **0.5** | | |
| (2b) 80% coal | 72.4 | 2.6 | 3.9 | 21.1 |
| 0.75 lb/ft$^2$ cover | **96.5** | **3.5** | | |

FIG. 20

| | Nuggets | | Slag | | | (S)/[S]*** |
|---|---|---|---|---|---|---|
| | %C | %S | %Fe | %FeO | %S | |
| **LHF 26* (2600 °F)** | 3.68* | 0.030* | 0.00 | 0.23 | 1.39 | 46.3 |
| **LHF 27 (2600 °F)** | | | | | | |
| (a) 80% coal 1.25 lb/ft$^2$ cover | 3.81 | 0.020 | 0.03 | 0.27 | 1.09 | 54.5 |
| (b) 80% coal 1.0 lb/ft$^2$ cover | 3.18 | 0.025 | 0.20 | 0.50 | 1.03 | 41.2 |
| (bp)** 80% coal 1.0 lb/ft$^2$ cover | 3.33** | 0.076** | 0.82 | 1.20 | 0.82 | 10.8** |
| (c) 80% coal 0.75 lb/ft$^2$ cover | 3.74 | 0.030 | 0.31 | 0.55 | 1.04 | 34.7 |
| **LHF 28 (2550 °F)** | | | | | | |
| (c) 80% coal 0.5 lb/ft$^2$ cover | 2.65 | 0.034 | 0.26 | 0.54 | 1.13 | 33.2 |
| **LHF 29 (2550 °F)** | | | | | | |
| (1a) 80% coal 1.0 lb/ft$^2$ cover | 3.28 | 0.024 | 0.00 | 0.21 | 1.22 | 50.8 |
| (2a) 110% coal 1.0 lb/ft$^2$ cover | 3.48 | 0.029 | 0.00 | 0.23 | 1.32 | 45.5 |
| (1b) 80% coal 0.75 lb/ft$^2$ cover | 3.63 | 0.020 | 0.00 | 0.23 | 1.21 | 60.5 |
| (2b) 110% coal 0.75 lb/ft$^2$ cover | 3.80 | 0.016 | 0.00 | 0.23 | 1.31 | 81.9 |

FIG. 21

| | Nuggets | | Slag | | | (S)/[S]*** |
|---|---|---|---|---|---|---|
| | %C | %S | %Fe | %FeO | %S | |
| **LHF 30 (2550 °F)** | | | | | | |
| (a) 1.25 lb/ft$^2$ cover | 3.05 | 0.021 | 0.11 | 0.32 | 1.24 | 59.0 |
| (b) 1.0 lb/ft$^2$ cover | 3.31 | 0.029 | 0.10 | 0.36 | 1.24 | 42.8 |
| (c) 0.75 lb/ft$^2$ cover | 3.57 | 0.032 | 0.00 | 0.28 | 1.13 | 35.3 |
| **LHF 31 (2550 °F)** | | | | | | |
| (1a) 4/6 mesh 0.75 lb/ft$^2$ cover | 2.89 | 0.027 | 0.00 | 0.27 | 1.16 | 43.0 |
| (2a) 4/6 mesh 1.0 lb/ft$^2$ cover | 2.96 | 0.025* | (0.03)** | (0.22) | (1.21) | (48.4) |
| (1b) -1/2"+3/8" 0.75 lb/ft$^2$ cover | 3.5 | 0.024 | 0.00 | 0.14 | 1.33 | 55.4 |
| (2b) -1/2"+3/8" 1.0 lb/ft$^2$ cover | 3.25 | 0.023 | 0.02 | 0.21 | 1.20 | 52.2 |
| **LHF 32 (2550 °F)** | | | | | | |
| (1a) 4/6 mesh 0.5 lb/ft$^2$ cover | 3.11 | 0.039 | 0.12 | 0.40 | 1.29 | 33.1 |
| (2a) 4/6 mesh 0.75 lb/ft$^2$ cover | 2.40 | 0.029 | 0.16 | 0.35 | 1.20 | 41.4 |
| (1b) -1/2"+3/8" 0.5 lb/ft$^2$ cover | | | 0.00 | 0.31 | 1.31 | |
| (2b) -1/2"+3/8" 0.75 lb/ft$^2$ cover | 3.47 | 0.026 | 0.00 | 0.33 | 1.17 | 45.0 |
| **LHF 33 (2550 °F)** | | | | | | |
| (1a) Dry briquettes 1.0 lb/ft$^2$ cover | 2.70 | 0.079* | (0.17) | (0.49) | (1.05) | (13.3) |
| (2a) Wet briquettes 1.0 lb/ft$^2$ cover | 3.06 | 0.054* | (0.06) | (0.32) | (1.10) | (20.4) |
| (1b) Dry briquettes 0.75 lb/ft$^2$ cover | 3.10 | 0.047* | (0.02) | (0.24) | (1.15) | (24.5) |
| (2b) Wet briquettes 0.75 lb/ft$^2$ cover | 3.07 | 0.048* | (0.48) | (0.64) | (1.13) | (23.5) |

* Iron products not fully fused
** Numbers in parentheses associated with iron products not fused.
*** %S in slag divided by %S in metal.

FIG. 21 (cont.)

| Hearth layer thickness | Cover layer in lb/ft$^2$ 0.75 | 1.0 |
|---|---|---|
| Single layer | | |
| 1/2" | 24 min | 28 min |
| 1" | 28 min | 33 min |
| Double layers | | |
| 1/2" | 31 min | 36 min |
| 1" | 38 min | 42 min |
| Triple layers | | |
| 1/2" | 45 min | 51 min |
| 1" | 51 min | 57 min |

FIG. 26

| Hearth layer (inch) | Cover layer (lb/ft$^2$) | Productivity (No. of NRI/minute) Single layer | Double layers | Triple layers |
|---|---|---|---|---|
| 1 | 1 | 2.9 | 4.4 | 4.6 |
| 1 | 0.75 | 3.4 | 4.8 | 5.2 |
| 1/2 | 1 | 3.4 | 5.1 | 5.2 |
| 1/2 | 0.75 | 4.0 | 5.9 | 5.9 |

FIG. 27

| | Single layer | Double layer | Triple layer |
|---|---|---|---|
| Loosely packed | | | |
| Loading, lb/ft$^2$ | 2.0 | 3.9 | 5.6 |
| Fusion time, min | 33 | 38 | 51 |
| Closely packed | | | |
| Loading, lb/ft$^2$ | 3.1 | 6.1 | 8.8 |
| Fusion time, min | 36 | 57 | 63 |

FIG. 28

| | Briquette processing rates, lb/ft$^2$/h | | |
|---|---|---|---|
| | Single layer | Double layer | Triple layer |
| Loosely packed | 3.6 | 6.2 | 6.6 |
| Closely packed | 5.2 | 6.4 | 8.4 |

FIG. 29

METHOD AND SYSTEM FOR PRODUCING METALLIC IRON NUGGETS

This application is a continuation of and claims priority to and the benefit of international patent application number PCT/US2009/032519 filed on Jan. 30, 2009, published as international publication number WO 2009/105320 A3, which in turn claims priority to and the benefit of U.S. Provisional Patent Application Ser. No. 61/024,861 filed on Jan. 30, 2008. The disclosures of both are hereby incorporated by reference.

GOVERNMENT INTERESTS

The present invention was made with support by the Economic Development Administration, Grant No. 06-69-04501, and the Department of Energy, Sponsor Award DE-FG36-05GO15185. The United States government may have certain rights in the invention.

BACKGROUND

The present invention relates to the reduction iron bearing material, such as iron ore, to metallic iron.

Many different iron ore reduction processes have been described and/or used in the past. The processes may be traditionally classified into direct reduction processes and smelting reduction processes. Generally, direct reduction processes convert iron ores into a solid state metallic form with, for example, use of shaft furnaces (e.g., natural gas-based shaft furnaces), whereas smelting reduction converts iron ores into molten hot metal without the use of blast furnaces.

The conventional reduction processes for production of direct reduced iron (DRI) involve heating beneficiated iron ores to below the melting point of iron, below 1200° C. (2372° F.), either by gas-based processes or coal-based processes. For example, in the gas-based process, direct reduction of iron oxide (e.g., iron ores or iron oxide pellets) employs the use of a reducing gas (e.g., reformed natural gas) to reduce the iron oxide and obtain DRI. Methods of making DRI have employed the use of materials that include carbon such as coal and coke as a reducing agent. A typical composition of DRI is 90 to 95% metallization and 2-4% gangue, but has not been practical for steelmaking processes as a replacement of scrap because its oxygen and gangue content increases energy usage, increase slag volume, and necessitates the addition of costly reagents.

Natural gas-based direct reduced iron accounts for over 90% of the world's production of DRI. Coal-based processes are generally used in producing the remaining DRI production. However, in many geographical regions, the use of coal may be more desirable because coal prices may be more stable than natural gas prices. Further, many geographical regions are far away from steel mills that use the processed product. Therefore, shipment of iron units in the form of iron nuggets produced by a coal-based direct reduction process may be more desirable than use of a smelting reduction process.

Another reduction process in gas-based or coal-based directly reducing iron bearing material to metallic nuggets is often referred to as fusion reduction. Such fusion reduction processes, for example, generally involve the following processing steps: feed preparation, drying, preheating, reduction, fusion/melting, cooling, product discharge, and metallic iron/slag product separation. These processes result in direct reduction of iron bearing material to metallic iron nuggets and slag. Metallic iron nuggets produced by these direct reduction processes are characterized by high grade reduction, nearing 100% metal (e.g., about 96% to about 97% metallic Fe). Percents (%) herein are percents by weight unless otherwise stated.

Unlike conventional direct reduced iron (DRI), these metallic iron nuggets have low oxygen content because they are metallic iron and have little or no porosity. These metallic iron nuggets are also low in gangue because silicon dioxide has been removed as slag. Such metallic iron nuggets are desirable in many circumstances such as use in place of scrap in electric arc furnaces. These metallic iron nuggets can be also produced from beneficiated taconite iron ore, which may contain 30% oxygen and 5% gangue. As a result, with such metallic iron nuggets, there is less weight to transport than with beneficiated taconite pellets and DRI. In addition, generally, such metallic iron nuggets are just as easy to handle as taconite pellets and DRI.

Various types of hearth furnaces have been described and used for direct reduction of metallic iron nuggets. One type of hearth furnace, referred to as a rotary hearth furnace (RHF), has been used as a furnace for coal-based direct reduction. Typically, the rotary hearth furnace has an annular hearth partitioned into a preheating zone, a reduction zone, a fusion zone, and a cooling zone, between the supply location and the discharge location of the furnace. The annular hearth is supported in the furnace to move rotationally. In operation, raw reducible material comprising a mixture of iron ore and reducing material is charged onto the annular hearth and provided to the preheat zone. After preheating, through rotation, the iron ore mixture on the hearth is moved to the reduction zone where the iron ore is reduced in the presence of the reducing material and fused into metallic iron nuggets, using one or more heat sources (e.g., gas burners). The reduced and fused product, after completion of the reduction process, is cooled in the cooling zone on the rotating hearth, preventing oxidation and facilitating discharge from the furnace.

One exemplary metallic iron nugget direct reduction process for producing metallic iron nuggets is referred to as ITmk3® by Kobe Steel. In such a process, dried balls formed using iron ore, coal, and a binder are fed to a rotary hearth furnace. As the temperature increases in the furnace, the iron ore concentrate is reduced and fuses when the temperature reaches between 1450° C. to 1500° C. The resulting products are cooled and then discharged. The intermediate products generally are shell-shaped, pellet-sized metallic iron nuggets with slag inside, from which the metallic iron can be separated.

Another direct reduction process for making metallic iron nuggets has also been reportedly used. See U.S. Pat. No. 6,126,718. In this process, a pulverized anthracite coal layer is spread over a hearth and a regular pattern of dimples is made therein. Then, a layer of a mixture of iron ore and coal is placed over the dimples, and heated to 1500° C. The iron ore is reduced to metallic iron, fused, and collected in the dimples as iron pebbles and slag. Then, the iron pebbles and slag are broken apart and separated.

Both of these direct reduction processes for producing metallic iron nuggets have involved mixing of iron-bearing materials and a carbonaceous reductant (e.g., pulverized coal). Either with or without first forming dried balls, iron ore/carbon mixture is fed to a hearth furnace (e.g., a rotary hearth furnace) and heated to a reported temperature of 1450° C. to approximately 1500° C., to form metallic iron nuggets and slag. Metallic iron and slag can then be separated, for example, with use of mild mechanical action and magnetic separation techniques.

A particular problem with the metallic iron nuggets formed by these previous direct reduction processes was the sulfur content of the nuggets. Sulfur is a major impurity in direct reduced metallic iron nuggets. In the past, carbonaceous reductants utilized in direct reduction processes of iron ore have generally resulted in metallic iron nuggets with at least 0.1% or more by weight sulfur. This high level of sulfur has made the metallic iron nuggets made by direct reduction undesirable in many steelmaking processes, and particularly in the electric arc furnace processes.

Attempts have been made to form metallic iron nuggets with low sulfur content in these previous direct reduction processes using large amounts of additives containing $MgCO_3$ or MgO. Problems, such as increased energy consumption and increased refractory wear, have occurred with fusing these nuggets due to the increases in slag melting temperature caused by MgO in the slag. See EP 1 605 067.

SUMMARY

A method and system are disclosed that provide for various advantages in the reduction processes in the production of metallic iron nuggets. Multiple layers of a reducible iron mixture are provided with a substantial increase in productivity. Furthermore, the hearth layer may comprise at least in part of a mixture comprised of coal, non-coking coal or non-caking coal. A method for use in the production of metallic iron nuggets is disclosed that comprises providing a hearth comprising refractory material; positioning a hearth material layer comprising at least carbonaceous material on the refractory material; positioning on the hearth material layer a stratum of agglomerates comprising reducing material and reducible iron bearing material and having a major dimension and a minor dimension, where the stratum has an average depth of at least about 1.7 times in the minor dimension, and heating the agglomerates to form from at least some of the agglomerates metallic iron nuggets and slag. The stratum of agglomerates may be placed in two layers, three layers, or more. Moreover, the agglomerates may comprise briquettes, extrusions, balls, or other shapes. If placed in layers, the layers of agglomerates may comprise a density of at least 2.5 $lb/ft^2$/layer, or at least 2.9 $lb/ft^2$/layer. An overlayer of coarse carbonaceous material may be placed over at least a portion of the agglomerates.

A method for use in the production of metallic iron nuggets is also disclosed that comprises providing a hearth comprising refractory material, positioning a hearth material layer comprising at least carbonaceous material on the refractory material, positioning at least two layers of agglomerates comprised of reducing material and reducible iron bearing material on the hearth material layer, and heating the agglomerates to form from at least some of the agglomerates metallic iron nuggets and slag. The agglomerates may be placed in two layers, three layers, four layers, or more. Moreover, the agglomerates may comprise briquettes, extrusions, balls, or any of a plurality of other shapes. The layers of agglomerates may comprise a density of at least 2.5 $lb/ft^2$/layer, or at least 2.9 $lb/ft^2$/layer. An overlayer of coarse carbonaceous material may be placed over at least a portion of the agglomerates.

Fine divided coal may be included as part of the hearth material layer. In one embodiment, the hearth material layer may comprise a mixture of non-coking coal and a material selected from the group consisting of coke, char and other carbonaceous material. In another embodiment, the hearth material layer may comprise a mixture of non-caking coal and a material selected from the group consisting of coke, char and other carbonaceous material. In yet another embodiment, sub-bituminous coal or Powder River Basin coal may be utilized in the mixture.

In one embodiment, the finely divided coal may comprise twenty five percent or less of the hearth material layer. In other embodiments, the coal particles may comprise fifty percent or less of the hearth material layer, seventy five percent or less of the hearth material layer, or any amount up to and including one hundred percent of the hearth material layer.

In addition or in the alternative, the finely divided particles of coal in the hearth layer may have a particle size less than 4 mesh, and in some embodiments a particle size between 100 and 20 mesh or 6 mesh. Particle sizes less than 100 mesh should be avoided because these particles sizes tend to have more ash content. The thickness and particle size of the carbonaceous and other material in the hearth layer should be selected so that the hearth layer protects the hearth refractory from slag and molten metal formed during reduction of the reducible mixture, while optionally avoiding production of excess ash. The carbonaceous material in the reducible mixture is also different in particle size from those of the coarse overlayer, but for the different considerations. In the reducible mixture, a consideration is the surface area for rapid reaction of the carbonaceous material with the reducible iron bearing material in commercial production. Less than 65 mesh or less than 100 mesh particle size of carbonaceous material in the reducible mixture is effective for efficient reduction of the iron oxide to produce metallic iron nuggets.

The coarse carbonaceous material of the overlayer has an average particle size greater than an average particle size of the hearth layer. In addition or alternatively, the overlayer of coarse carbonaceous material may include discrete particles having a size greater than about 20 mesh or greater than about 6 mesh, and in some embodiments, the overlayer of coarse carbonaceous material may have discrete particles with a size between about 20 mesh or about 6 mesh and about ½ inch (12.7 mm) The coarse carbonaceous material may be coke, non-caking coal, char, or a combination of one or more of these.

The overlayer of coarse carbonaceous material may provide between 50% and 100% coverage of the agglomerates of reducible mixture and may be about ½ inch (12.7 mm) in thickness. Further, in some embodiments of the method, the coverage of the overlayer of coarse carbonaceous material may be between about 0.5 $lb/ft^2$ (2.44 $kg/m^2$) and about 1 $lb/ft^2$ (4.88 $kg/m^2$) of coarse carbonaceous material, or between about 0.75 $lb/ft^2$ (3.66 $kg/m^2$) and about 1 $lb/ft^2$ (4.88 $kg/m^2$) of coarse carbonaceous material over the reducible mixture.

In some embodiments of the disclosed method, the step of providing a reducible mixture over at least a portion of the hearth material layer may comprise forming at least a portion of the reducible mixture with a predetermined quantity of reducing material between about 70 percent and about 90 percent of said stoichiometric amount of reducing material necessary for complete metallization. The stoichiometric amount of reducing material is the calculated amount of carbonaceous material needed for complete metallization of iron in the formation of metallic iron nuggets from a predetermined quantity of reducible iron bearing material.

The above summary of embodiments of the present invention is not intended to describe each embodiment or every implementation of the present invention. Advantages, together with a more complete understanding of the invention, will become apparent and appreciated by referring to the following detailed description and claims taken in conjunction with the accompanying drawings.

BRIEF DESCRIPTION OF THE DRAWING

FIG. 4 shows a table giving chemical compositions of one or more additives that may be used in one or more embodiments of the metallic iron nugget process described generally in FIG. 1, and/or for use in other processes that form metallic iron nuggets.

FIGS. 8-10 show tables for use in describing the effect of adding calcium fluoride or fluorspar to a reducible mixture in a metallic iron nugget process such as that shown generally in FIG. 1, and/or for use in other processes that form metallic iron nuggets.

FIGS. 11, 12 and 13 show a table, an illustration, and another table, respectively, for use in showing the effect of $Na_2CO_3$ and $CaF_2$ additives to a reducible mixture with respect to control of sulfur levels in one or more exemplary embodiments of a metallic iron nugget process such as that shown generally in FIG. 1, and/or for use in other processes that form metallic iron nuggets.

FIG. 15 is a table showing the effect of slag composition on a reduction process for use in describing one or more tests employing a linear hearth furnace shown in FIG. 3.

FIG. 16 is a table showing analytical results of iron nuggets and slag for use in describing one or more tests employing a linear hearth furnace shown in FIG. 2D.

FIG. 19 is a table showing analytical results of iron nuggets and slag for use in describing one or more tests employing a linear hearth furnace as shown in FIG. 3.

FIG. 20 table showing analytical results of weight distribution of iron nuggets, micro-nuggets, +20 mesh magnetic fraction and slag for use in describing one or more tests employing a linear hearth furnace shown in FIG. 3.

FIG. 21 is a table showing analytical results of iron nuggets and slag for use in describing one or more tests employing a linear hearth furnace shown in FIG. 3.

FIG. 26 is a table illustrating how the thickness of the hearth layer and density of the coarse cover layer affect fusion time in single, double, and triple layers of agglomerates.

FIG. 27 is a table illustrating how the thickness of the hearth layer and density of the coarse cover layer affect fusion productivity in single, double, and triple layers of agglomerates.

FIG. 28 is a table illustrating how the density of the agglomerates affects fusion time in single, double, and triple layers of agglomerates.

FIG. 29 is a table illustrating how the density of the agglomerates affects processing rates in single, double, and triple layers of agglomerates.

DETAILED DESCRIPTION

Certain embodiments of a process for the production of metallic iron nuggets are described with reference to FIGS. 1-3. Various other embodiments of the process for the production of metallic iron nuggets and examples supporting such various embodiments are also described with reference to the other Figures as described below. The method and system for producing metallic iron nuggets as will be described in further detail by way of example, together with one or more of the resulting benefits and features. As explained in detail hereinafter, the disclosed process permits the control of the amount of sulfur to produce a novel intermediate slag/metallic nugget product, and with separation, novel metallic iron nuggets.

Figure 1:
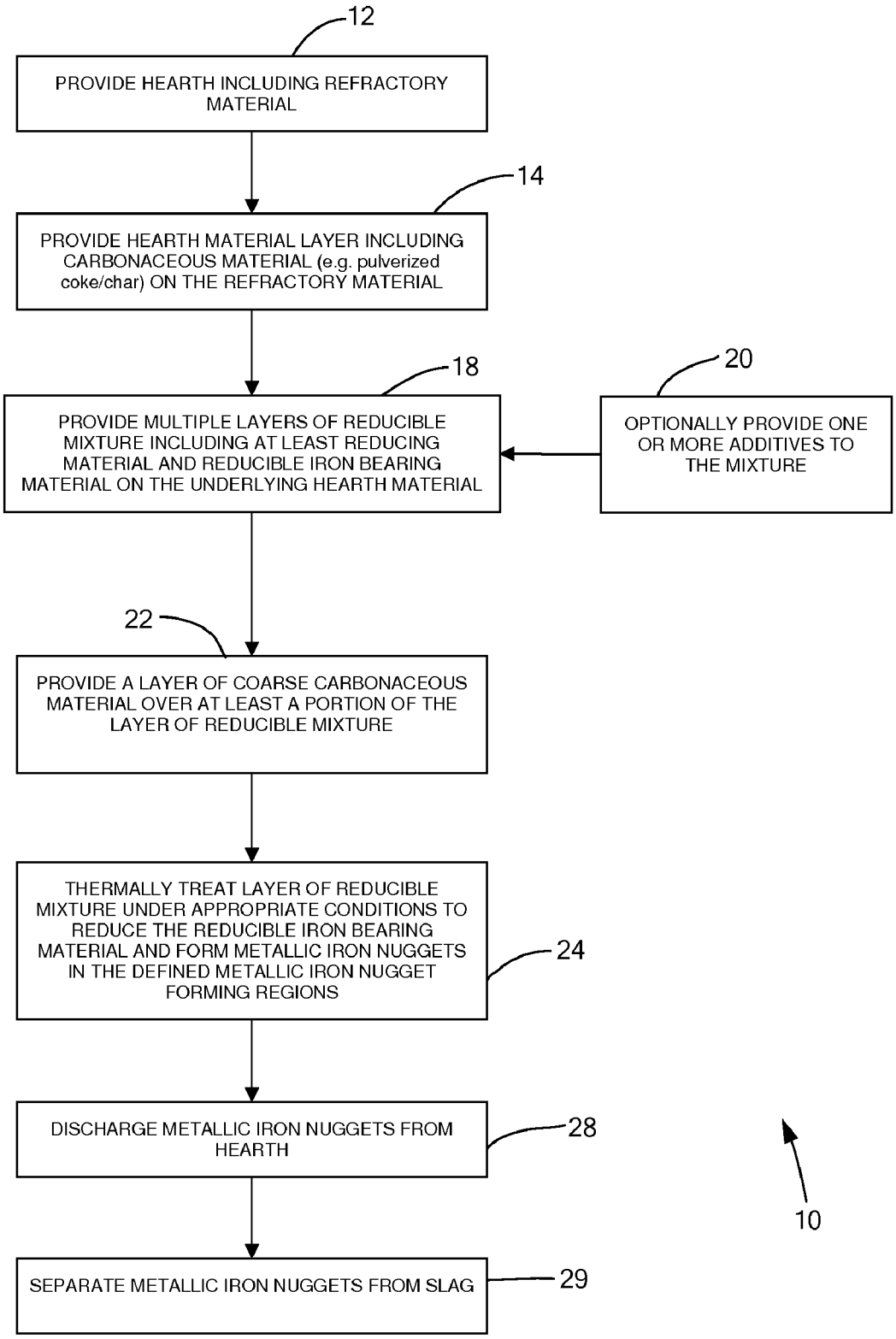
FIG. 1 shows a block diagram of one or more general embodiments of a metallic iron nugget process.

FIG. 1 shows a block diagram of one or more generalized illustrative embodiments of a metallic iron nugget process 10. The metallic iron nugget process 10 shown in the block diagram shall be described with further reference to a more detailed embodiment shown in FIG. 3. One skilled in the art will recognize that one or more of the process steps described with reference to the metallic iron nugget process 10 may be optional. For example, blocks 20, and 26 are labeled as being optionally provided. As such, it will be recognized that the metallic iron nugget process 10 is an illustrative embodiment, and that the present invention is not limited to any specific process embodiments described herein, but rather as described in the accompanying claims.

Figure 5:
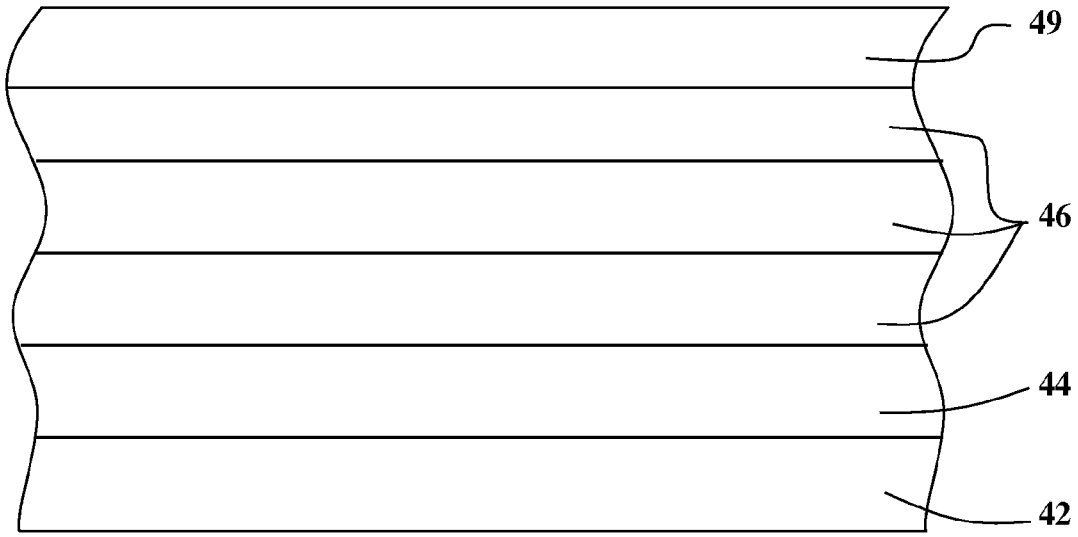
FIG. 5 is a generalized cross-section view of a hearth and the layers thereon.

As shown in block 12 of FIG. 1, a hearth 42 is provided as shown in FIG. 5. The hearth 42 may be any moving hearth suitable for use with a furnace system 30 (e.g., such as that shown generally in FIG. 2) operable for use in carrying out the metallic iron nugget process 10, or another metallic nugget processes that incorporate one or more features described herein. Generally, hearth 42 includes a refractory material upon which reducible material to be processed (e.g., feed material) is received. Hearth 42 may be a hearth suitable for use in a rotary hearth furnace, a linear hearth furnace (e.g., as shown in FIG. 3), or any other furnace system operable for implementation for direct reduction of metallic iron nuggets. The refractory material may be, for example, refractory board, refractory brick, ceramic brick, or a castable refractory.

Further, a combination of refractory board and refractory brick may be selected to provide maximum thermal protection for an underlying substructure. In one or more embodiments, the hearth may include a supporting substructure that carries a refractory material (e.g., a refractory lined hearth) forming hearth 42. The supporting substructure may be formed from one or more different materials, such as, for example, stainless steel, carbon steel, or other metals, alloys, or combinations thereof that have the required high temperature characteristics for furnace processing.

With reference to block 14 of FIG. 1, a hearth material layer 44 is provided on hearth 42. The hearth material layer 44 includes at least one carbonaceous material.

As used herein, carbonaceous material refers to any carbon-containing material suitable for use as a reductant with the iron-bearing material. According to one or more particularly advantageous embodiments, the hearth material layer 44 includes coke, char, other carbonaceous material, or mixtures thereof. For example, anthracite coal, low volatile bituminous coal, medium volatile bituminous coal, high volatile bituminous coal, sub-bituminous coal, coke, graphite, or other sub-bituminous char materials may be used for the hearth layer 44. Some low, medium, and high volatile bituminous coals may not be suitable for use as hearth layers by themselves, but may be used as make-up materials to pulverized bituminous char. Also, coke materials such as coke breeze may be used. The carbonaceous material of the hearth layer may contain an amount of sulfur in a range from about 0.2% to about 1.5%, and more typically, in the range of 0.5% to 0.8%.

The hearth material layer may be comprised of a mixture of finely divided coal and a material selected from the group of coke, char, and other carbonaceous material found to be beneficial to increase the efficiency of iron reduction. The coal particles may be a mixture of different coals such as non-coking coal, non-caking coal, sub-bituminous coal, Powder River Basin ("PRB") coal, or lignite. Additionally, although up to one hundred percent coal is contemplated for use as a hearth material layer, in some embodiments, the finely divided coal may comprise up to twenty-five percent (25%) mixed with coke, char, other carbonaceous material, or mixtures thereof. In other embodiments, up to fifty percent (50%) of the hearth material layer may comprise coal, or up to seventy-five percent (75%) of the hearth material layer may comprise coal, with the remaining portion coke, char, other carbonaceous material, or mixtures thereof.

One advantage of the addition of coal to the hearth material layer is contemplated to be the volatiles in the coal that are available to be combusted and provide heat for the process. The volatiles can be directly burned near the location of their volatilization from the coal, or may be communicated a different location in the furnace to be burned at a more desirable location. In any case, the volatiles can be consumed to heat the reducible material efficiently. Thus, the addition of coal may decrease the necessity for external fuel sources, while still protecting the hearth refractories.

The hearth material layer 44 is of a thickness sufficient to prevent slag from penetrating the hearth material layer 44 and contacting refractory material of hearth 42. For example, the carbonaceous material may be ground or pulverized to an extent such that it is fine enough to prevent the slag from such penetration, but typically not so fine as to create excess ash. As recognized by one skilled in the art, contact of slag with the hearth 42 during the metallic iron nugget process 10 produces undesirable damage to the refractory material of hearth 42. A suitable particle size for the hearth layer is less than 4 mesh and desirably between 4 and 100 mesh, with a reasonable hearth layer thickness of about ½ inch or more, is effective protection for the hearth 42 from penetration of the slag and metallic iron during processing. Carbonaceous material less than 100 mesh is generally high in ash and also may result in entrained dust that is difficult to handle in commercial operations.

Further, referring to block 18 of FIG. 1, multiple layers of reducible mixture 46 are provided on the underlying hearth material layer 44. The multiple layers of reducible mixture include at least a reducible iron-bearing material and reducing material for the production of iron metal nuggets.

As used herein, iron-bearing material includes any material capable of being formed into metallic iron nuggets via a metallic iron nugget process 10 as described herein. For example, the iron-bearing material may include iron oxide material, iron ore concentrate, taconite pellets, recyclable iron-bearing material, pellet plant wastes and pellet screened fines. Further, such pellet plant wastes and pellet screened fines may include a substantial quantity of hematite. In addition, such iron-bearing material may include magnetite concentrates, oxidized iron ores, steel plant wastes (e.g., blast furnace dust, basic oxygen furnace (BOF) dust and mill scale), red mud from bauxite processing, titanium-bearing iron sands and ilmenites, manganiferous iron ores, alumina plant wastes, or nickel-bearing oxidic iron ores. Also, less expensive iron ores high in silica may be used. Other reducible iron bearing materials may also be used for making the reducible mixture for producing metallic iron nuggets used in the processes described herein to produce metallic iron nuggets. For example, nickel-bearing laterites and garnierite ores for ferronickel nuggets, or titanium bearing iron oxides such as ilmenite that can be made into metallic titanium iron nuggets (while producing a titania rich slag), or iron rich oxides which contain manganese oxides can be used to produce manganese iron nuggets.

At least in some embodiments, such iron-bearing material may be ground to less than 65 mesh (i.e., −65 mesh) or less than 100 mesh (i.e., −100 mesh) in size for processing according to the disclosed processes. The various examples presented herein use iron-bearing material ground to 100 mesh and less unless otherwise specified. However, larger size particles of iron-bearing material may also be used. For example, pellet screened fines and pellet plant wastes are generally approximately 3 mesh (about 0.25 inches) in average size. Such material may be used directly, or may be ground to −65 or −100 mesh to provide larger surface contact of carbonaceous reductant with the iron bearing material during processing. The reduction process is generally more effective to efficiently produce metallic iron nuggets with increased surface area with more finely divided material.

The mesh size of the discrete particles is measured by Tyler Mesh Size for the measurements given herein.

The carbonaceous material for the reducible mixture may be ground to 100 mesh or less in size for processing. In another embodiment, such carbonaceous material is provided in the range of −65 mesh to −100 mesh. However, carbonaceous material in the range of −200 mesh to −8 mesh may also be used. The use of coarser carbonaceous material (e.g., coal) may require increased amounts of coal in the reducible mixture for carrying out the reduction process. Finer ground carbonaceous material may be more effective in the reducible mixture. Even larger size carbonaceous material may also be used. For example, carbonaceous material of less than about 6 to 7 mesh (e.g., about 0.13 inch to about 0.11 inch) in average size may be used. Such larger size material may be used directly, or may be ground to −65 or −100 mesh for better contact and more efficiently react with the iron-bearing reducible material during processing. The various examples presented herein use carbonaceous material ground to −100 mesh unless otherwise specified. When other additives are also added to the reducible mixture, such additives may also ground to −100 mesh or less in size.

Various carbonaceous materials may be used in providing the reducible mixture of reducing material and reducible iron-bearing material. For example, eastern anthracite and bituminous non-caking coals may be used as the carbonaceous reductant in at least one embodiment. However, in some geographical regions, such as on the Iron Range in Northern Minnesota, the use of western sub-bituminous non-caking coal offers an attractive alternative, as such coals are more readily accessible with the rail transportation systems already in place, plus they are generally lower in cost and lower in sulfur levels. As such, western sub-bituminous coals may be used in one or more processes as described herein. Further, an alternative to the direct use of sub-bituminous coals may be to carbonize it, e.g., at 900° C., prior to its use. In any case, the carbonaceous material in the reducible mixture may contain an amount of sulfur in a range from about 0.2% to about 1.5%, and more typically, in the range of 0.5% to 0.8%.

The amount of reducing material in the mixture of reducing material and reducible iron bearing material will depend on the stoichiometric quantity necessary for complete metallization of the iron in the reducing reaction in the furnace process. As described further below, such a quantity may vary depending on the furnace used and the furnace atmosphere in which the reducing reaction takes place. In one or more embodiments, the quantity of reducing material necessary to carry out the reduction of the iron-bearing material is between about 70 percent and 90 percent of the stoichiometric quantity of reducing material theoretically necessary for carrying out the reduction to completely metalize the iron. Such carbonaceous material may be used at different stoichiometric levels (e.g., 70 percent, 80 percent or 90 percent) of the stoichiometric amount necessary for reduction of the iron-bearing material. In one embodiment, for agglomerates containing coal at 80% of the stoichiometric amount to completely reduce the iron oxide, balls have a density of about 2.1, and briquettes or extrusions have a density of about 2.1. This feature of the invention is described in more detail below.

The reducible mixture 46 may have a thickness of more than 0.25 inches (6.35 mm) and less than 2.0 inches (50.8 mm). In some embodiments, the reducible mixture 46 may have a thickness of less than 1 inch (25.4 mm) and more than 0.5 inches (12.7 mm). In other embodiments, the reducible mixture 46 may have a thickness of about 0.5 inches or less (12.7 mm or less). For example, an embodiment of a briquette may have a dimension of 1.33 inches by 0.84 inches by 0.56 inches. Such briquettes would have a major dimension of 1.33 inches and a minor dimension of 0.56 inches. In another embodiment, a briquette may have a dimension of 1.38 inches by 0.88 inches by 0.48 inches. Such briquettes would have a major dimension of 1.38 inches and a minor dimension of 0.48 inches. The thickness of the reducible mixture is generally limited and/or dependent upon the effective heat penetration therein. Increased surface area of iron bearing material and carbonaceous material in the reducible mixture allows for improved heat transfer and reduction activity.

As shown by block 20 of FIG. 1, additives may optionally be provided to the reducible mixture, for one or more purposes, in addition to the reducing material (e.g., coal or char) and reducible iron-bearing material (e.g., iron oxide material or iron ore). For example, additives may be provided (i) for controlling slag basicity, (ii) for binders to provide binder functionality (e.g., lime can act as a weak binder in a micro-agglomerate configuration when wetted), (iii) for controlling the slag fusion temperature, (iv) to reduce the formation of micro-nuggets, and/or (v) for further controlling the content of sulfur in resultant iron nuggets formed by the metallic iron nugget process 10. The table of FIG. 4 shows the chemical compositions of various additives to the reducible mixture 46. That includes, for example, chemical compositions such as $Al(OH)_3$, bauxite, bentonite, $Ca(OH)_2$, lime hydrate, limestone, and Portland cement. Other additives may also be used such as $CaF_2$, $Na_2CO_3$, fluorspar, soda ash, aluminum smelter slag, cryolite, and $SiO_2$. One or more of such additives, separately or in combination, may provide for beneficial results when used in the metallic iron nugget process 10. These additives and their impact particularly in reducing sulfur levels in the metallic iron nuggets is explained in more detail below. Some of the illustrated additives contain trace amounts of Mg, as shown. Mg, in compounds such as dolomite, should be avoided and in any event is not used in quantities that will produce 5% mass or more MgO in the resulting slag.

The reducible mixture 46 may be then formed into agglomerates such as briquettes, balls, or extrusions for use in the disclosed process of forming metallic iron nuggets. It should also be noted that different pressurization during formation of the agglomerates may result in different processing characteristics as desired for the particular embodiment of the present process.

With reference to FIG. 1, as shown in block 22, a layer containing coarse carbonaceous material 49 may be provided over multiple layers of agglomerates of the reducible mixture. The coarse carbonaceous material of the overlayer has an average particle size greater than an average particle size of the hearth layer. In addition or alternatively, the overlayer of coarse carbonaceous material may include discrete particles having a size greater than about 4 mesh or about 6 mesh and in some embodiments, the overlayer of coarse carbonaceous material may have discrete particles with a size between about 4 mesh or 6 mesh and about ½ inch (about 12.7 mm) There may be of course some discrete particles less than 4 mesh or 6 mesh in size when discrete particles greater than 4 mesh or 6 mesh size are desired, but the majority of the discrete particles will be greater than 4 mesh or 6 mesh where a particle size greater than 6 mesh is desired. The coarse carbonaceous material may be coke, coal, char, or a combination of one or more of these.

With the formed agglomerates of reducible material 46 provided on the hearth material layer 44 and with the carbonaceous overlayer 49 in place, a reducing furnace 34 (shown in FIG. 2) is provided to thermally directly reduce the layers of reducible mixture 46 to produce one or more metallic iron nuggets in one or more of the plurality of agglomerates. The reducing furnace 34 may include any suitable furnace regions or zones for providing the appropriate conditions (e.g., drying/heating, reducing, fusion and cooling zones) for processing the reducible mixture 46 of the agglomerates to form one or more metallic iron nuggets. For example, a linear hearth furnace, or any other furnace capable of performing the thermal treatment (block 24 of FIG. 1) of the reducible mixture 46 may be used.

Slag beads on hearth material layer 44 are separated from the iron nuggets or attached thereto. With reference to block 28 of FIG. 1, the metallic iron nuggets and slag (e.g., attached slag beads) are discharged from the hearth, and the discharged metallic nuggets are then separated from the slag (block 29).

The presence of CO in the furnace atmosphere accelerated the fusion process somewhat as compared to a $N_2$ only atmosphere; the presence of $CO_2$ in furnace atmospheres adjacent the reducible material slowed the fusion behaviors of metallic iron nuggets. A presence of $CO_2$ in furnace atmospheres during iron nugget formation starting at about 1325° C. (2417° F.), wherein the temperature was on the verge of forming fused iron nuggets, has been observed to inhibit the formation of the metallic iron nuggets. The effect of $CO_2$ became less pronounced at higher temperatures and, in fact, the effect became virtually absent over 1400° C. (2552° F.) because of $CO_2$ forming 2 CO at above such temperature. This effect is shown by the plot set forth as FIG. 14. This finding is observed mainly in the $N_2$ and CO atmosphere in the tube furnace or the box furnace. Also, the presence of carbon near the hot reduced iron will allow the iron to pick up carbon in solution. This carbonizing of the iron reduces the melting point of the iron and in turn lowers the process temperature for full fusion of the metallic iron.

The process of formation of the metallic iron nuggets is markedly improved by the overlayer 49 of coarse carbonaceous material. The partitioning of the sulfur in the slag of the intermediate slag/metallic nugget product is improved by lowering the sulfur levels in the metallic iron nuggets without large amounts of MgO in the slag. As formed, the carbonaceous material of the coarse overlayer may contain an amount of sulfur in a range from about 0.2% to about 1.5%, and more typically, in the range of 0.5% to 0.8%.

Metallic iron nugget processes that differ from that described with reference to FIG. 1 (e.g., the ITmk3 process, the Hi-QIP process) also can be adapted to practice the process described herein and to produce the novel intermediate slag/nugget product with high sulfur partitioning into the slag. In these embodiments, the same reducing material and same iron bearing materials may be used (i.e., type of composition), but the form of the reducible mixture on the hearth may be different. For example, the form that the reducible mixture takes may be preformed green balls using binder, rather than briquettes or other type of agglomerates. As such, the process may be used to form novel intermediate products with ratios of sulfur in slag to sulfur in nuggets of greater than 12, or 15 or 30, and novel metallic iron nuggets with less than 0.03% sulfur, and not just with the process described above with reference to FIG. 1.

Figure 2:
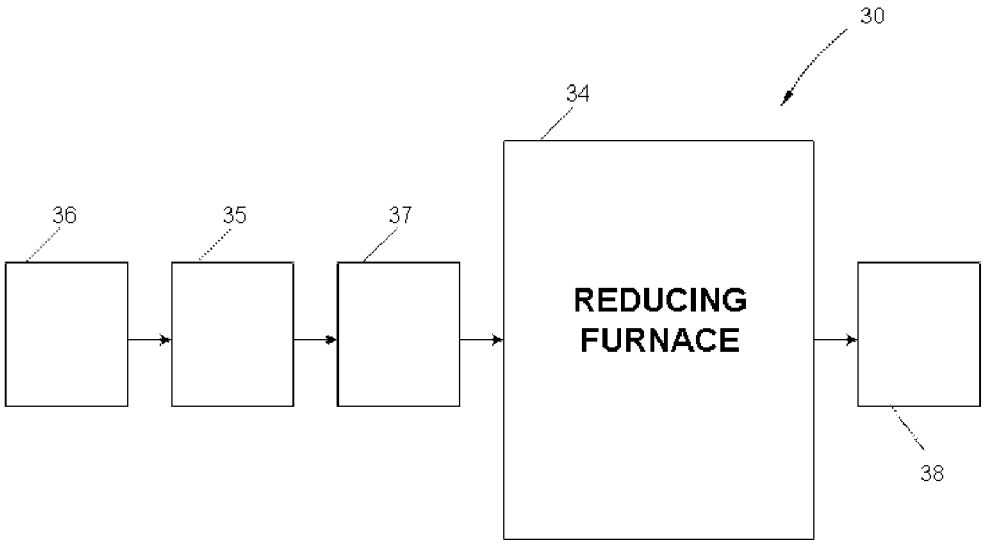
FIG. 2 is a generalized block diagram of a furnace system for implementing a metallic iron nugget process such as that shown generally in FIG. 1.
Figure 3:
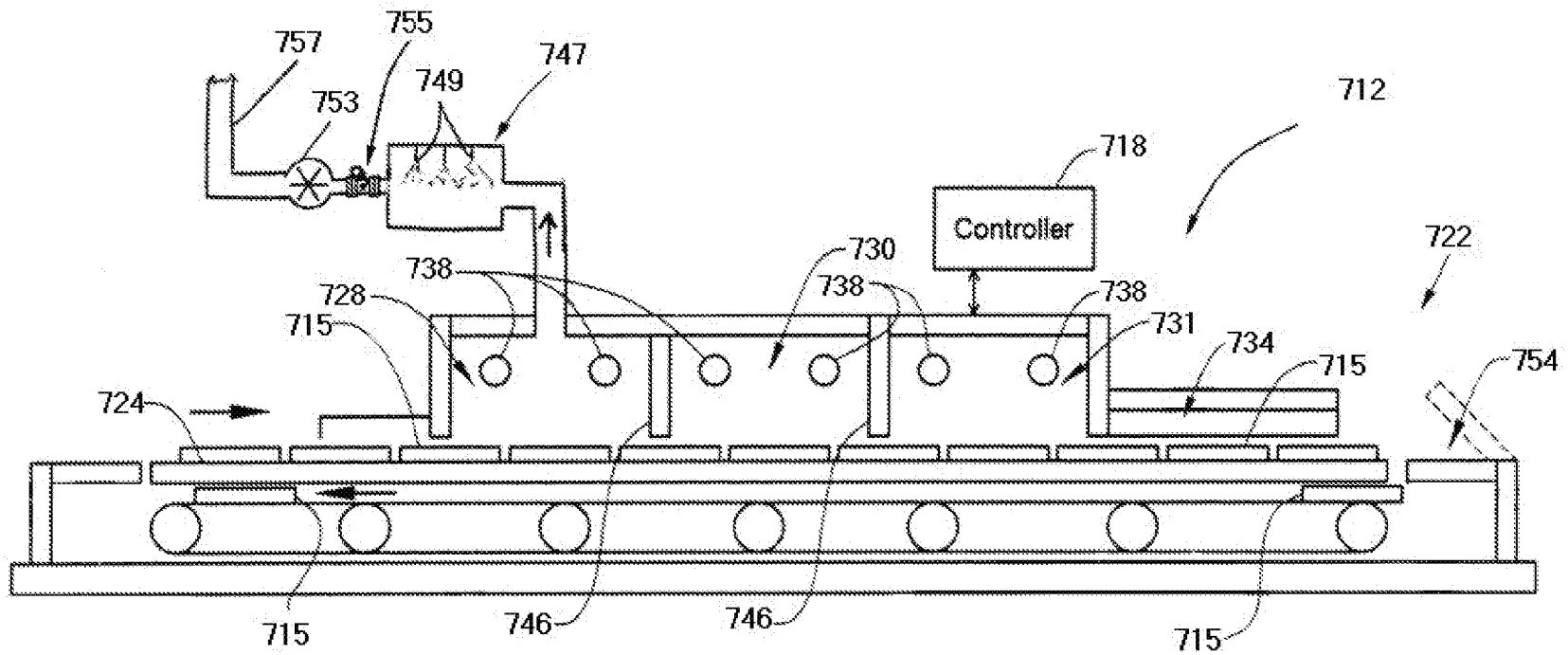
FIG. 3 is a diagram of a linear hearth furnace that may be used to carry out one or more processes described herein, and produce one or more products described herein.

The metallic iron nugget process 10 may be carried out by a furnace system 30 as shown generally in FIG. 2. The furnace system 30 generally includes a charging apparatus 36 operable to provide a layer of reducible mixture 46 on at least a portion of hearth material layer 44. The charging apparatus may include any apparatus suitable for providing a reducible mixture 46 onto a hearth material layer 44. A controllable feed chute, a leveling device, and a feed direction apparatus may be used to place such reducible mixture on the hearth 42.

Apparatus 37 can also be used to provide the coarse carbonaceous overlayer 49 over the agglomerates, which may also partially fill the areas surrounding the agglomerates.

Further as shown in FIG. 2, the furnace system 30 includes a discharge apparatus 38 used to remove the metallic nuggets and the slag formed during processing by the furnace system 30, and discharge such components (e.g., metallic iron nuggets and slag) from the system 30 after the metallic iron nuggets are cooled and solidified. The discharge apparatus 38 may include any number of various discharge techniques including gravity-type discharge (e.g., tilting of a tray including the nuggets and slag) or techniques using a screw discharge device or a rake discharge device. One will recognize that any number of different types of discharge apparatus 38 may be suitable for providing such discharge of the nuggets (e.g., iron nugget and slag bead aggregates). Further, a separation apparatus may then be used to separate the metallic iron nuggets from the slag beads. Any method of breaking and separating the iron nugget and slag bead aggregates may be used, e.g., tumbling in a drum, screening, or a hammer mill. However, any suitable separation apparatus may be used (e.g., a magnetic separation apparatus).

In the absence of any other information of the furnace gas composition of iron nugget processes, most of the laboratory tests in a box furnace described herein were carried out in an atmosphere of 67.7% $N_2$ and 33.3% CO, assuming that $CO_2$ in a natural gas-fired burner gas would be converted rapidly to CO in the presence of carbonaceous reductants and hearth layer materials by the Boudouard (i.e., carbon solution) reaction ($CO_2$+C=2CO) at temperatures higher than 1000° C., and a CO-rich atmosphere would prevail at least in the vicinity of the reducible materials largely by reason of the presence of the coarse overlayer. In these tests, carbon dioxide often predominated and could reach levels of over 16%. The use of the coarse carbonaceous overlayer, however, enabled production of metallic iron nuggets even under these adverse conditions.

One or more different reducing furnaces may be used according to the disclosed processes depending on the particular application of the disclosed processes. For example, in one or more embodiments herein, laboratory furnaces were used to perform the thermal treatment. One will recognize that from the laboratory furnaces, scaling to mass production level can be performed and the present processes contemplate such scaling. As such, one will recognize that various types of apparatus described herein may be used in larger scale processes, or production equipment necessary to perform such processes at a larger scale may be used.

For example, a linear hearth furnace such as that described in U.S. Provisional Patent Application No. 60/558,197, entitled "Linear hearth furnace system and methods," filed 31 Mar. 2004, published as US 2005/0229748A1, may also be used. A summary of the linear hearth furnace described therein is as follows. One exemplary embodiment of such a linear hearth furnace is shown generally in FIG. 3 and, may be, a forty-foot long walking beam iron reduction furnace 712 including three heating zones 728, 730, 731 separated by internal baffle walls 746, and also including a final cooling section 734. As described herein, various tests were also run using this linear hearth furnace and results thereof are described with reference to the Figures.

Zone 728 is described as an initial heating and reduction zone. This zone may operate on two natural gas-fired 450,000 BTU (113,398 Kcal) burners 738 capable of achieving temperatures of 1093° C. The burners are typically operated sub-stoichiometrically to minimize oxygen levels.

Zone 730 is described as the reduction zone. This zone may operate on two natural gas-fired 450,000 BTU (113,398 Kcal) burners 738 capable to achieve 1316° C. The reduction of the feed mixture occurs in this zone 730.

Zone 731 is described as the melting/fusion zone. This zone may operate on two natural gas-fired 1,000,000 BTU (251,995 Kcal) burners 738 capable to sustain this zone at 1426° C. The function of this zone is to complete the reduction, fusing the iron into metallic iron nodules or "nuggets". In the event that this furnace is being used to make direct reduced iron or sponge iron, the temperatures in this zone would be reduced where complete reduction would be promoted without melting or fusion.

The walking beam 724 transports trays 715 to the opposite end 722 of the furnace where they are discharged onto a similar platform (roller ball plate) elevator 754. A safety mechanism has been installed to monitor the position of the hot trays at the discharge of the furnace. Discharge rollers drive the trays onto the platform elevator where they can be removed or re-inserted back into the furnace. The discharge rollers will not function unless trays are in position for discharge, platform elevator is in the "up" position, and the walking beams have been lowered to prevent hot trays from accidental discharge. Tiered conveyor rollers are located at the discharge of the furnace to remove and store sample pallets until cool.

The exhaust gas system 747 is connected to an exhaust fan 753 with a variable flue damper controlled by the furnace PLC. Because the exhaust fan 753 is oversized for this application, a manually controlled in-line damper or pressure control 755 is used to reduce the capacity of the exhaust fan 753 to improve zone pressure control. As a safety precaution, a barometric leg into a level controlled water tank is installed between the common header and exhaust fan to absorb any sudden pressure changes. Exhaust gases are discharged from the fan 753 to a forty-foot exhaust stack 757. The exhaust ducts are refractory lined to the exterior walls of the furnace where they transition to high temperature stainless steel (RA602CA), fitted with water spray nozzles 749, used to cool the waste gases.

The sample trays or pallets 715 have 30 inch square refractory lined pans with a flat bottom to be conveyed through the furnace by the walking beam mechanism 724. The trays framework may be made from a 303 stainless steel alloy or carbon steel. They may be lined with high temperature refractory brick or ceramic fiberboard with sidewalls to contain the feed mixture.

The above described furnace systems are given to further illustrate the nugget formation process 10, and has provided certain aspects in testing and the results reported herein. However, any suitable furnace system capable of carrying out one or more embodiments of a metallic iron nugget formation process described herein may be used.

Control of Stoichiometric Amount of Reducing Material

In previous metallic iron reduction processes, such as those using dried balls described in the Background of the Invention above, carbonaceous reducing materials are typically added to the reducible mixture in an amount greater than the theoretical stoichiometric amount required to complete reduction the iron oxides. This is done to promote carburizing of metallic iron in order to lower the melting point and the reduction temperature of the reducible mixture to metallic iron. The amount of carbonaceous reductant in the balls includes an amount required for reducing iron oxide plus an amount required for carburizing metallic iron and for loss associated with oxidation.

As discussed previously, in certain furnaces (e.g., such as natural gas fired furnaces with high $CO_2$ and highly turbulent gas atmospheres), added carbonaceous material (e.g., coal) in feed mixtures (e.g., such as those reducible mixtures described herein) is lost by the carbon solution (Boudouard) reaction in certain zones of the furnace (e.g., pre-heating and reduction zones). To compensate for this loss, it may be necessary to add reducing material (e.g., carbonaceous material) in excess of the stoichiometric amount theoretically necessary for complete metallization. However, also as described herein, such an addition of reducing material (e.g., coal) in excess of the stoichiometric amount may lead to formation of larger amounts of micro-nuggets, i.e., nuggets that are too large to pass through a 20 mesh screen (+20 mesh material) and less than about ⅛" (about 3 mm). Such micro-nugget formation we have found related to the gas turbulence and its composition in the furnace atmosphere in an area near the reducible mixture during processing.

Figure 17:
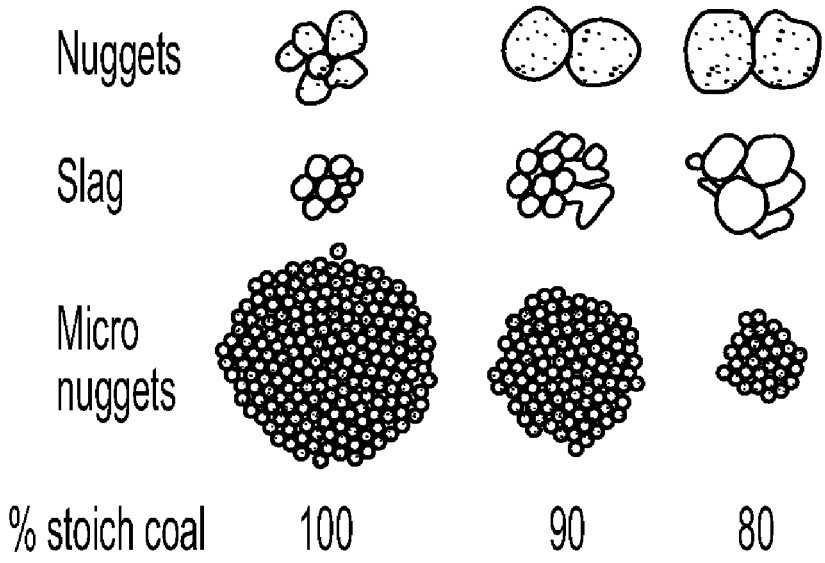
FIGS. 17 and 18 show the effect of use of various coal addition levels on one or more exemplary embodiments of a metallic iron nugget process as shown generally in FIG. 1, and/or for use in other processes that form metallic iron nuggets.
Figure 18:
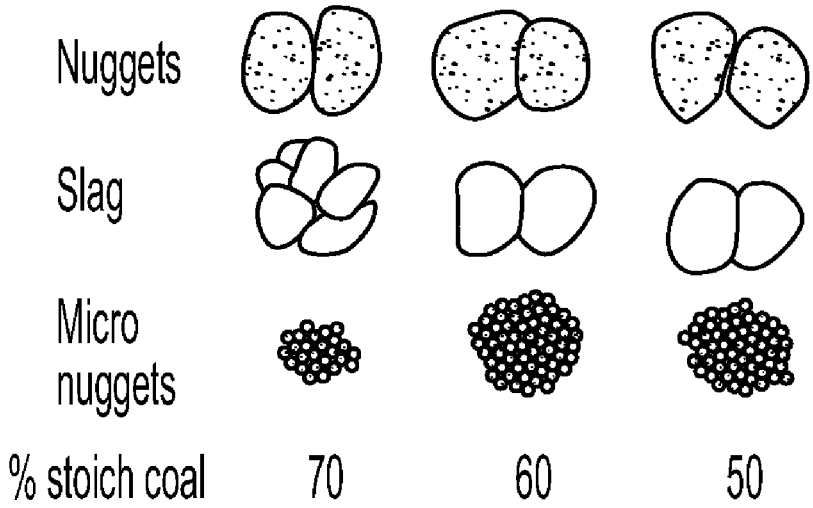

As previously described, in some embodiments of the disclosed processes, the reducible mixture includes a predetermined quantity of reducing material (e.g., carbonaceous reductant) between about 70 percent and about 90 percent of the stoichiometric amount necessary for complete metallization thereof. As seen in FIGS. 17-18, the addition of about 70% to about 90% of the theoretical amount minimized the formation of micro-nuggets. Carbon needed for further reduction and carbonizing molten metal came from, for example, CO in the furnace atmosphere from oxidization of the carbonaceous material of the coarse carbonaceous overlying layer 49 and underlying carbonaceous hearth material layer 44. The sub-stoichiometric carbon levels in the reducible mixtures are believed to assist in controlling the nucleation sites and inhibiting formation of small metallic nuggets that do not consolidate in larger nuggets. The stoichiometric requirements in carbon for complete reduction of the iron in the metallic nuggets are satisfied from the carbon in the hearth layer and the overlayer. These sources are believed to also provide the additional carbon needed for dissolved carbon in the iron phase of the metallic iron nuggets. The availability of carbon from the hearth layer and overlayer for solubilization into the reduced iron lowers its melting point, and in turn reduces the processing temperature needed for metal/slag separation.

In addition, the control of the amount of reducing material in the reducible mixture based on the stoichiometric amount theoretically necessary to complete the metallization process, applies not only to the methods described with reference to FIG. 1, but also to other direct reduction processes for forming metallic nuggets. The coarse overlayer together with the underlying hearth layer described herein reduces the formation of micronuggets formed in the reduction process.

Tests with Additives without a Coarse Overlayer.

These tests were preformed with a single layer of agglomerates, but the results are believed to be relevant to multiple layers of agglomerates.

As described previously with reference to FIG. 1, the reducible mixture 46 for use in the metallic iron nugget process 10 may include one or more additives in combination with the reducing material and the reducible iron-bearing material (e.g., reducible iron oxide material). One such method 200 for providing the reducible mixture 46 with optional additives is shown in the block diagram of FIG. 6. A mixture of at least reducing material of carbonaceous material such as coal, coke or charcoal and reducible iron oxide material are provided (block 202). Optionally in addition, calcium oxide or one or more compounds capable of producing calcium oxide upon thermal decomposition thereof (block 204) may be added to the reducible mixture. Further, in addition or alternatively, sodium oxide or one or more compounds producing sodium oxide upon thermal decomposition may be provided (block 206), in combination with the other components of the reducible mixture. Also, one or more fluxing agents may optionally may be provided for use in the reducible mixture (block 208). The fluxing agents that may be provided for use with the reducible mixture (block 208) may include any suitable fluxing agent. For example, an agent that assists in the fusion process by lowering the fusion temperature of the reducible mixture or increases the fluidity of the reducible mixture may be included. The additives may be naturally part of the reducible iron bearing material used as a source for the iron oxide, and typically may be 2% of the content of the reducible iron bearing material but may range from about 1% to about 7% by weight. In some embodiments, calcium fluoride ($CaF_2$) or fluorspar (e.g., a mineral form of $CaF_2$) may be used as the fluxing agent. Alternatively, $SiO_2$, borax, NaF, soda ash ($Na_2CO_3$), or aluminum smelting industry slag or cryolite, may be used as the fluxing agent. With respect to the use of fluorspar as the fluxing agent, about 0.5% to about 4% by weight of the reducible mixture may be fluorspar.

Use of fluorspar, for example, as well as one or more other fluxing agents, lowers the fusion temperature of the slag phase during formation of the metallic iron nuggets, and at the same time reduces the generation of micro-nuggets. Fluorspar has been found to lower not only the nugget formation temperature, but also to be uniquely effective in decreasing the amount of micro-nuggets generated. It is believed that the lower temperature slag allows for removal of slag from the reducing iron and formation of the metallic iron nuggets.

Figure 7:
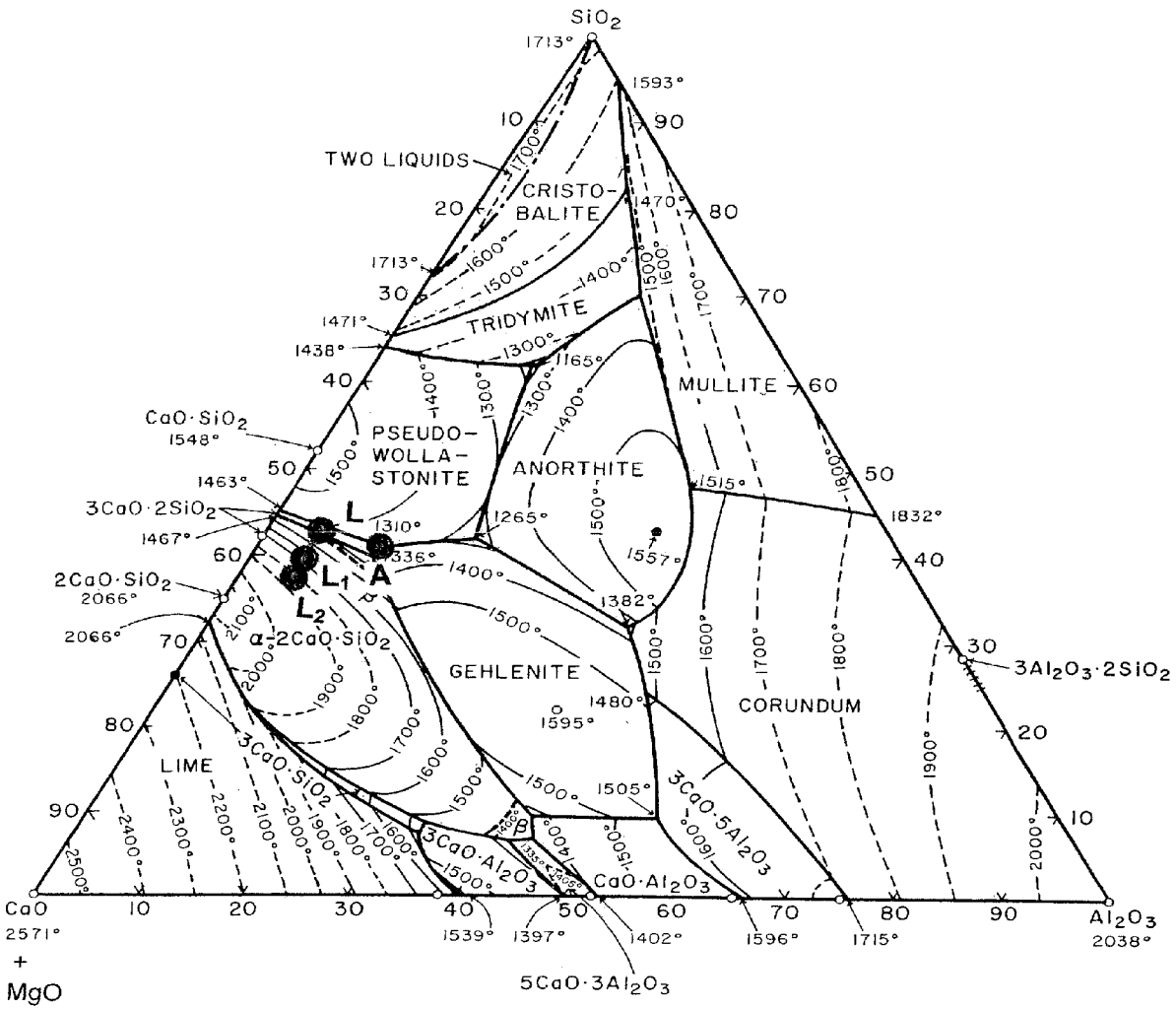
FIG. 7 shows a $CaO—SiO_2—Al_2O_3$ phase diagram.

In an attempt to improve sulfur removal capacity of slag, as shall be described further herein, the level of lime or one or more other compounds capable of producing calcium oxide may also be increased beyond a composition (L), as shown on the $CaO—SiO_2—Al_2O_3$ phase diagram of FIG. 7 that indicates the slag compositions of (A), (L), ($L_1$), and ($L_2$). Composition (L) is located in the low fusion temperature trough in the $CaO—SiO_2—Al_2O_3$ phase diagram. The slag compositions are abbreviated by indicating the amounts of additional lime used in percent as a suffix, for example, ($L_1$) and ($L_2$) indicate lime addition of 1% and 2%, respectively, over that of Composition (L). The amount of chemical $CaF_2$ (abbreviated to CF) added in percent was also indicated as a suffix, for example, ($L_{0.5}CF_{0.25}$), which represents that 0.25% by weight of $CaF_2$ was added to a feed mixture with Slag Composition of ($L_{0.5}$).

It is common practice in the steel industry to increase the basicity of slag by adding lime to slag under a reducing atmosphere for removing sulfur from metallic iron, for example, in blast furnaces. However, increasing lime from Slag Composition (L) to ($L_{1.5}$) and ($L_2$) may lower sulfur but increase the fusion temperature and the amount of micro-nuggets generated as described herein. In the present process, the use of fluxing additives that lower the slag fusion temperature, such as fluorspar, may be used to (i) lower the temperature of iron nugget formation, (ii) decrease sulfur in the iron nuggets, and, (iii) decrease the amount of micro-nuggets formed in processing. For example, addition of certain additives, such as fluorspar to the feed mixture may reduce the amount of micro-nuggets produced during processing of the reducible feed mixture.

Although fluorspar is reported to be a not particularly effective desulfurizer in steelmaking slag, we have found that with increasing fluorspar addition, sulfur in iron nuggets was found to be lowered more effectively at Slag Compositions ($L_{1.5}$) and ($L_2$) than at ($L_1$). Therefore, the use of fluorspar not only lowered the operating temperature and further lowered the sulfur in iron nuggets, but also has also been found to have the unexpected benefit of minimizing the generation of micro-nuggets in the metallic iron nuggets. It is believed that the melting temperature for the slag components is lower when fluorspar is employed. An increased amount of liquid slag is thus available to interact with the sulfur and capture the sulfur within the slag. If lime is present as an additive, the slag volume is increased and the fluorspar is more effective in increasing sulfur levels in the slag and decreasing sulfur levels in the metallic iron nuggets.

Figure 6:
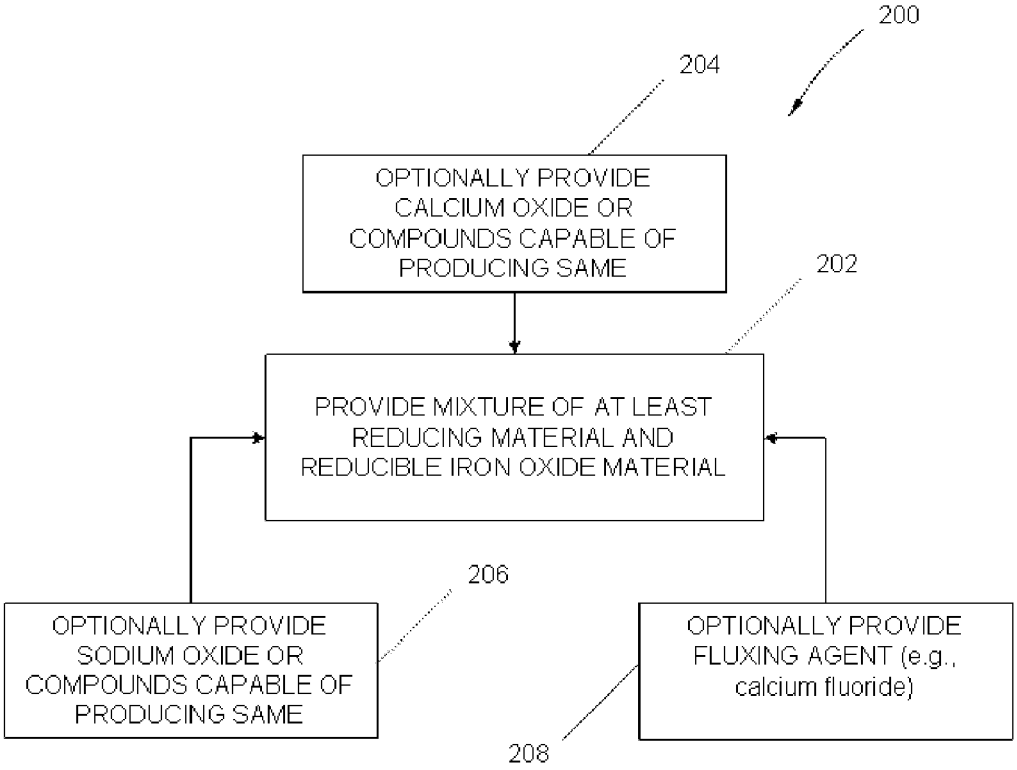
FIG. 6 shows a block diagram of one exemplary embodiment of a reducible mixture provision method for use in a metallic iron nugget process as shown generally in FIG. 1, and/or for use in other processes that form metallic iron nuggets.

With reference to FIG. 6, calcium oxide, and/or one or more compounds capable of producing calcium oxide upon thermal decomposition may also be used (block 204). For example, lime may be used as an additive to the reducible mixture. Increased use of lime decreased sulfur in iron nuggets from 0.084% to 0.05%. Increased use of lime, however, requires increasingly higher reduction temperatures and longer time at reduction temperature for forming fully fused metallic iron nuggets. As such, a substantial amount of lime is not desirable, as higher temperatures also result in less economical production of metallic iron nuggets, and reduces yields with increased formation of micronuggets. Yet, further decreases in sulfur content may be accomplished by use of the coarse overlayer of carbonaceous material as explained more fully herein.

Also shown in FIG. 6, sodium oxide, and/or one or more compounds capable of producing sodium oxide upon thermal decomposition, may be used in addition to lime (block 206) to lower sulfur in the formed metallic iron nuggets. Soda ash, $Na_2CO_3$, $NaHCO_3$, NaOH, borax, NaF and/or aluminum smelting industry slag, may be used to lower sulfur in the metallic iron nuggets (e.g., used in the reducible mixture). However, without the use of a coarse overlayer of carbonaceous material, the sulfur levels in the metallic nuggets by use of these additives has been found to range from 0.083% to 0.018% by weight.

The table of FIG. 13 shows the effect of temperature on analytical results of iron nuggets formed from reducible feed mixtures. The reducible feed mixture included a 5.7% $SiO_2$, magnetic concentrate, a Slag Composition ($L_{1.5}FS_1SC_1$), and medium-volatile bituminous coal at 80% of the stoichiometric requirement for metallization. The reducible feed mixture was heated in the tube furnace at the listed temperatures for 7 minutes in a $N_2$—CO atmosphere. As shown in the table of FIG. 13, sulfur in the iron nuggets decreased markedly with decreasing temperature from 0.029% S at 1400° C. to 0.013% S at 1325° C. An addition of $Na_2CO_3$ together with 1~2% $CaF_2$ not only lowered sulfur in the metallic iron nuggets to well below 0.05%, but also lowered the operating temperature and minimized the generation of micro-nuggets. Lowering the process temperature, therefore, is an additional advantage with the use of these additives, and the attendant lowering energy cost and maintenance, with lower sulfur in the metallic iron nuggets.

Generally, FIG. 8 shows the effect of fluorspar addition on analytical results of iron nuggets formed from feed mixtures that included a 5.7% $SiO_2$ magnetic concentrate, medium-volatile bituminous coal at 80% of the stoichiometric requirement for metallization and slag composition ($L_1$), ($L_{1.5}$), and ($L_2$). The samples in a 2-segment pattern in boats were heated at 1400° C. for 7 minutes in a $N_2$—CO atmosphere.

The table of FIG. 11 shows the effect of $Na_2CO_3$ and $CaF_2$ additions on sulfur analysis of iron nuggets at different levels of lime addition, the iron nuggets formed from feed mixtures that included a 5.7% $SiO_2$ magnetic concentrate, medium-volatile bituminous coal at 80% of the stoichiometric requirement for metallization, and slag composition ($L_mCF_1$ or $L_mFS_1$). The feed mixtures were heated in the tube furnace at 1400° C. for 7 minutes in a $N_2$—CO atmosphere.

Figure 12A:
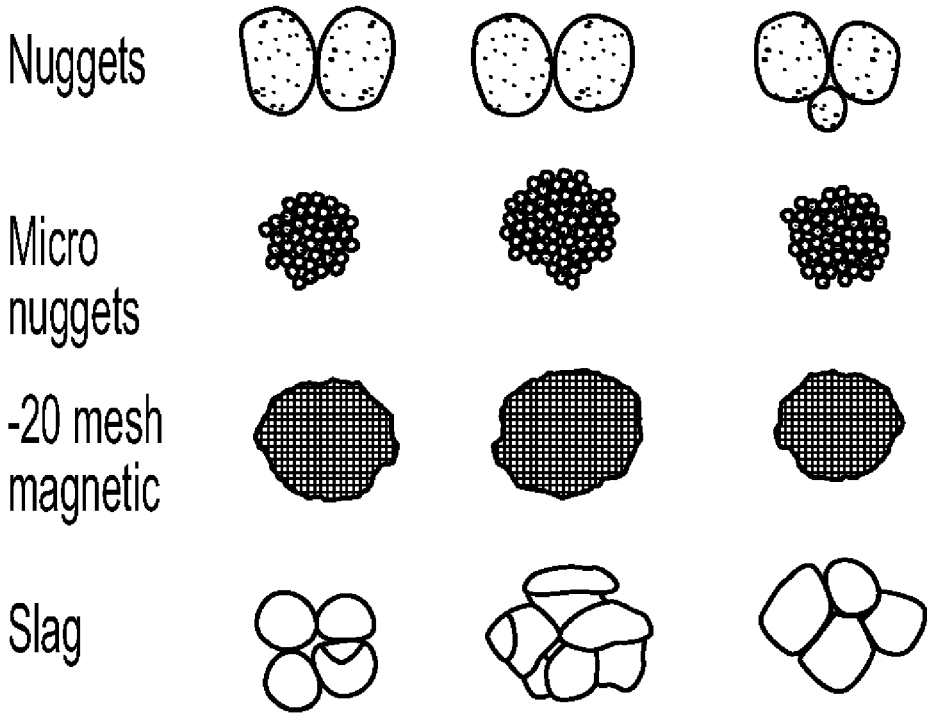

An addition of $Na_2CO_3$ without $CaF_2$ decreased sulfur in iron nuggets as effectively as, or even more effectively than the $CaF_2$, but the amount of micro-nuggets generated increased, as shown in FIGS. 12A-12C. When $CaF_2$ was used along with $Na_2CO_3$, the sulfur content in iron nuggets decreased even further and the amount of micro-nuggets remained minimal at about 1%. Another point of note was that the effect of $CaF_2$ in lowering the fusion temperature of iron nuggets was more pronounced at Slag Compositions ($L_1$), ($L_{1.5}$), and ($L_2$) than at Slag Compositions L and $L_{0.5}$. This analytical data shows that at least in this embodiment decrease in sulfur was more pronounced with soda ash than with increased addition of lime.

Although fluorspar is reported to be not particularly an effective desulfurizer in steelmaking slag, FIG. 8 shows that with increasing fluorspar addition, sulfur in iron nuggets was lowered more effectively at Slag Compositions ($L_{1.5}$) and ($L_2$) than at ($L_1$). At Slag Compositions ($L_{1.5}$) and ($L_2$), iron nuggets analyzed including 0.058% by weight sulfur and 0.050% by weight sulfur, respectively, while sulfur decreased steadily to as low as 0.013% and 0.009% by weight, respectively, at fluorspar addition of 4%. Therefore, the use of fluorspar not only lowered the operating temperature and the sulfur in iron nuggets, but also showed an unexpected benefit of minimizing the generation of micro-nuggets as shown in FIGS. 9 and 10.

Figure 14:
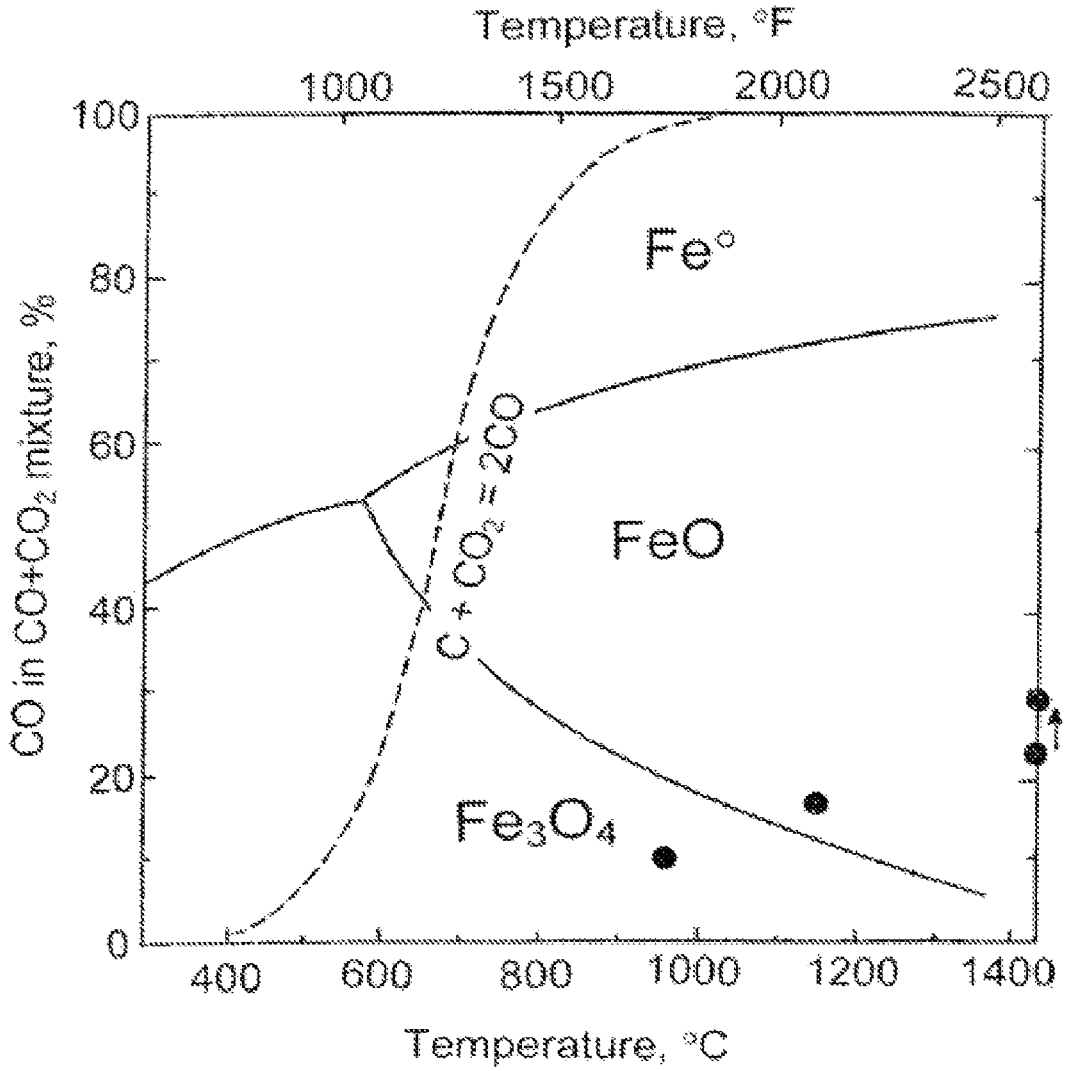
FIG. 14 is a graph showing concentrations of CO in various zones of a linear hearth furnace such as that shown in FIG. 3 for use in describing one or more tests employing such a furnace.

Concentrations of CO, expressed as percentages of $CO+CO_2$, were plotted in the equilibrium concentration diagrams of iron oxide reduction and carbon solution (Boudouard) reactions as shown in FIG. 14. The CO concentration in Zone 1 (1750° F. (954° C.)) was in the stability region of $Fe_3O_4$, and those in Zones 2 (2100° F. (1149° C.)) and Zone 3 (2600° F. (1427° C.)) were in the low range of the stability region of FeO. All the points were well below the carbon solution reaction, supporting a view that added coal was rapidly lost in the linear hearth furnace. The gas sampling ports of the linear hearth furnace were located on the furnace wall at about 8 inches above pallet surfaces. Because of the high turbulence of furnace gases, the CO concentrations of 4% should represent a well mixed value. The arrow at 2600° F. (1427° F.) in FIG. 14 indicates the increase in CO with time in Zone 3.

Analytical results of iron nuggets and slags of linear hearth furnace Tests 14 and 17 are given in FIG. 15, along with such results for another Test 15. In linear hearth furnace Test 15, a tray having an arrangement of feed mixtures in domes was used. The feed mixture of Test 15 included medium-volatile bituminous coal at 115% and 110% of the stoichiometric amount and at Slag Compositions ($L_{1.5}FS_1$), placed on a layer of −10 mesh coke. No overlayer of coarse carbonaceous material was used during these tests.

As shown in FIG. 15, sulfur in the iron nuggets ranged 0.152 to 0.266%, or several times to even an order of magnitude higher than those in iron nuggets formed in the laboratory tube and box furnaces with the same feed mixtures as shown and described previously with reference to FIG. 8. The slags were analyzed to confirm that they were indeed high in lime. Though the $CaO/SiO_2$ ratios ranged from 1.48 to 1.71, it was noted that the slags were high in FeO ranging from 6.0 to 6.7%. The FeO analyses of slags in the laboratory tube and box furnaces under identical slag compositions analyzed less than 1% FeO. The formation of high FeO slags was apparently responsible for higher sulfur in iron nuggets by interfering with de-sulfurizing. The use of an increased percentage of coal as well as the use of high sulfur coke (0.65% S) as a hearth layer as compared to low sulfur coke (0.40% S) in the laboratory tests might also have contributed to high sulfur in the iron nuggets. The ratio of sulfur in the slag over sulfur, (S)/[S], in the metallic iron nuggets by weight was only 0.64 and 1.40.

In FIG. 16, analytical results of iron nuggets and slag of linear hearth furnace Tests 14, 15, and 17, along with additional Tests 21 and 22 are shown. Carbon and sulfur in iron nuggets and iron, FeO and sulfur in slags for such Tests are summarized. In linear hearth furnace Tests 21 and 22, a pallet having an arrangement of different feed mixtures in 6-segment domes was used. The feed mixture included medium-volatile bituminous coal in the indicated percentages of the stoichiometric amount as shown in FIG. 16 and at the indicated Slag Compositions as shown in FIG. 16, placed on a −10 mesh coke layer. The temperature in Zone 3 was 25° F. (13.9° C.) higher at 2625° F. (1441° C.) in Tests 21 and 22.

As shown in FIG. 16, the FeO in slags was halved when a fluorspar addition was increased to 2% with attendant decrease in sulfur in iron nuggets. In view of the results of Test 17 with a fluorspar addition of 2%, the lower FeO might have been the results of a higher temperature of 2625° F. (1441° C.).

As these tests show, novel metallic iron nuggets with less than 0.05% sulfur can be produced with the addition of additives to the reducible mixture. However, these additives add to the expense of producing the metallic iron nuggets of the disclosed process.

Tests with Coarse Overlayer in the Linear Hearth Furnace

These tests were preformed with a single layer of agglomerates, but the results are believed to be relevant to multiple layers of agglomerates.

The products resulting from the linear hearth furnace tests were tested for the amount of sulfur in the metallic iron nuggets formed by the process and the amount of micro-nugget formation. These linear hearth furnace tests revealed that unexpectedly high $CO_2$ levels and highly turbulent furnace gas adjacent the reducible feed mixture during the reduction process consumed much of the carbonaceous material (e.g., added reducing material in the reducible iron bearing mixture) in Zones 1 and 2, and not enough reducing material was left for carburizing and melting the metallic iron in the high temperature zone (Zone 3). Use of coal in the amount of 105 to 125 percent of the stoichiometric amount was found necessary for forming fully fused metallic iron nuggets.

The tests were run using a 40-ft. long (12.19 m), natural gas-fired linear hearth furnace including three heating zones and a cooling section like that described with reference to FIG. 3. The heating schedule of feed samples in the furnace was modified to eliminate the baffle between the reduction zone (Zone 2) and the fusion or high temperature zone (Zone 3). No Mg was deliberately added beyond trace amounts or impurities found in the materials used.

Figure 22:
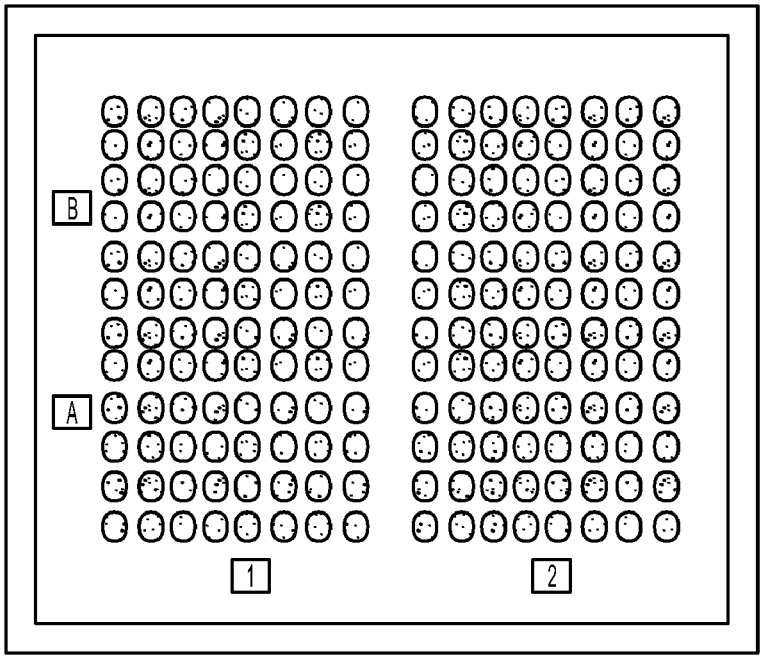
FIGS. 22-24 show a tray with an arrangement of briquettes containing different levels of feed mixtures with the use of different levels of coarse coke overlayer therein for use in describing one or more tests employing a linear hearth furnace as shown in FIG. 3, and the resulting product from a typical test.

Sample trays (or pallets) as illustrated in FIG. 22 were used in the tests. The trays were made from a 30 inch square carbon steel framework and were lined with high temperature fiber board (with sidewalls) to contain samples (i.e., the reducible mixture and products resulting after completion of reduction processing. The trays were conveyed through the furnace by a hydraulically driven walking beam system as described with reference to FIG. 3. A ½" (12.7 mm) layer of anthracite char of particle size between 6 and 100 mesh was used in each of the tests described below in this section, unless otherwise stated.

The sample tray traveled through Zone 1 at 1800° F. (982° C.) for 3 minutes without stopping, then through Zone 2 at 2400° F. (1316° C.) by moving one stroke of 5.5" (140 mm) every 16 seconds for a total time of 5 minutes. Then, the tray was moved to the center of Zone 3 (in 55 seconds) for a total time of 10 minutes. The tray was held in Zone 3 at 2600° F. (1427° C.) for long enough time to visually ascertain fusion of the mounds or briquettes, and then moved into the cooling zone without stoppage. The tray was held in the cooling zone for 20 minutes and then discharged.

It was found in previous tests that the coarse coke overlayer lowered the amount of micro-nuggets to 1 to 2%, as compared to 10-15% without a coarse coke coverage. In the previous tests, the coal addition of 85% of the stoichiometric amount again generated lower amounts of micro-nuggets.

The sulfur content in the metallic iron nuggets analyzed at about 0.04%. It is apparent that coarse coke overlayer of 50% (0.5 lb/ft$^2$, 2.44 kg/m$^2$) resulted in doubling the sulfur content over the previous test with an overlayer of 1.0 lb/ft$^2$, 4.88 kg/m$^2$, yet remained below 0.05% S. An increase in reductant coal in the reducible mixture from 85 to 95% of the stoichiometric amount appeared to increase the % S in the iron nuggets, suggesting that much of the sulfur came from reductant coal. Fe and FeO content of the slag were in the same range as in the test with full coverage (1.0 lb/ft$^2$, 4.88 kg/m$^2$), but the sulfur content of the slag was somewhat lower than 1%.

The conclusion of this series of tests is that the use of a coarse coke overlayer of 0.5 to 1.0 lb/ft$^2$ (50 to 100% coverage, 2.44 to 4.88 kg/m$^2$) enabled the formation of fully fused metallic nuggets and lowered the sulfur in iron nuggets to below 0.03%.

Figure 23:
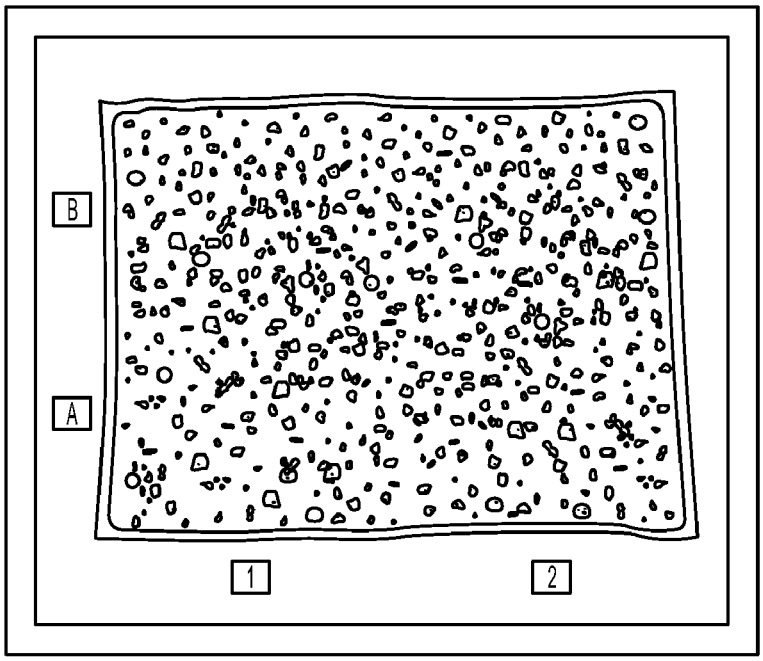

Test LHF 26 in FIG. 22 are dry briquettes with a coarse coke overlayer. To investigate the effect of coarse coke overlayer over dry briquettes, two columns of dry briquettes at 80% and 110% stoichiometric amount of coal without a binder were arranged as shown in FIG. 22. The briquettes were provided with a coarse coke overlayer between ¼" (6.35 mm) and ½" (12.7 mm) particle size at 1.0 and 0.75 lb/ft$^2$ (4.88 and 3.66 kg/m$^2$) in Rows (a) and (b), respectively. A sheet of paper was placed over the feed mixtures to prevent accidental mixing with coarse coke when the coke was distributed over the reducible feed mixture. The coke-overlayered feed is shown in FIG. 23. The tray was held at 2552° F. (1400° C.) for 20 minutes in Zone 3.

Figure 24:
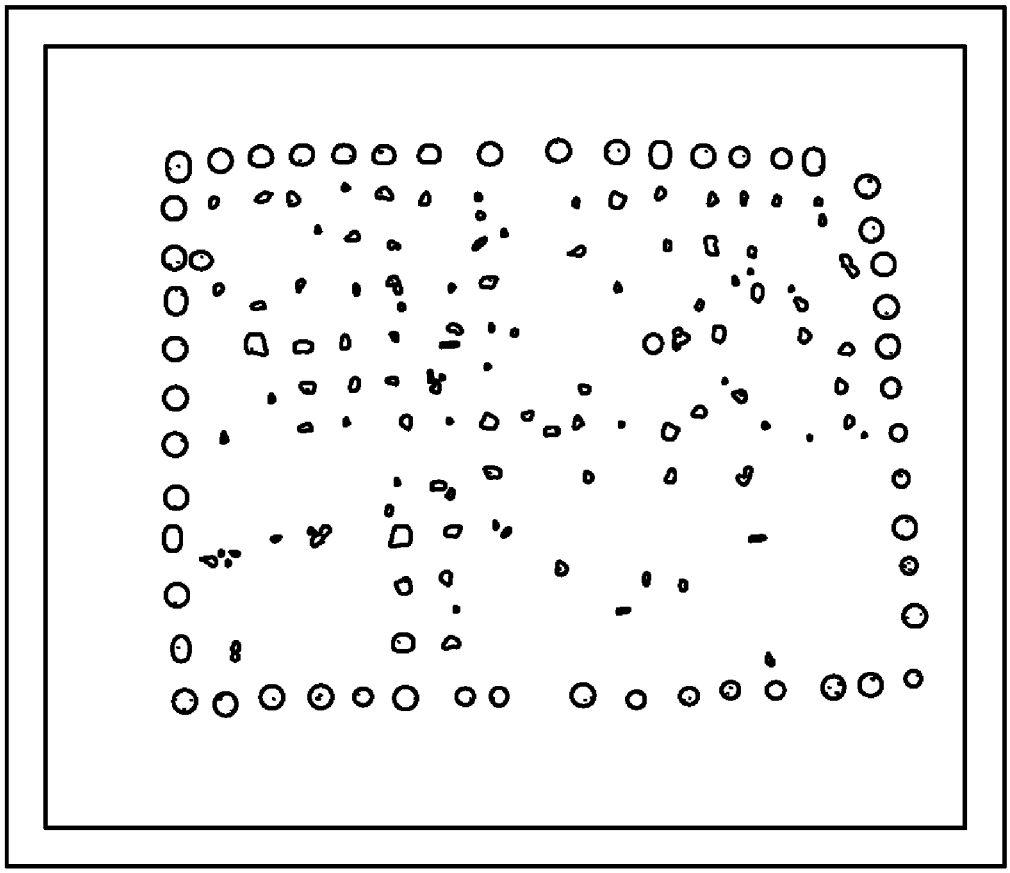

As shown in FIG. 24, the products of the briquettes were 100% fused into metallic nuggets. Most of the iron nuggets in the periphery, particularly at 0.75 lb/ft$^2$ which is Section (b), were associated with black covered slag, while the slag associated with the iron nuggets in the interior was essentially white. This difference was attributed to the fact that the coarse coke particles rolled off around the periphery and the fused iron nuggets and slag were exposed to the turbulent furnace gas and oxidized at the periphery. The analytical results are shown in FIG. 21. The metallic iron nuggets analyzed 0.030% 5 and 3.68% C, while the slag analyzed low in iron and 1.39% S. The ratio of sulfur in the slag over sulfur in the metallic nuggets by weight, (S)/[S], was calculated to be 46.

Two iron nuggets and associated slag were selected from Section (c) with 0.75 lb/ft$^2$ coke coverage, and analyzed. The analytical results are shown in FIG. 21. The sulfur analyses of the iron nuggets was 0.034% S and the iron analyses of the slag were 0.26% Fe and 0.54% FeO. The ratio of the sulfur in the slag over the sulfur in the nuggets by weight, (S)/[S], was 33.

Test LHF 29 was briquettes with different degrees of coarse coke overlayer at a lower temperature. In Test LHF 26, the products formed at 1427° C. (2600° F.) were all fused into metallic iron nuggets. In this test, an identical tray of dry briquettes overlayered with coarse coke, as shown in FIG. 22, was sent through the furnace according to the standardized heating schedule, but with the temperature of Zone 3 lowered to 1399° C. (2550° F.) and kept at that temperature for 20 minutes.

All of the briquettes were fully fused into metallic iron nuggets. The iron nuggets, however, were notably smaller than those from the mounds as the briquettes were only half the size and weight of the mounds. The weights of the metallic nuggets are shown in FIG. 20.

Micro-nuggets at 80% stoichiometric amount of coal were low, 1.0 and 0.5%, for coarse coke overlayers of between ¼" (6.35 mm) and ½" (12.7 mm) particle size at 1.0 and 0.75 lb/ft$^2$ (4.88 and 3.77 kg/m$^2$) coverage, respectively. Meanwhile, those at 110% stoichiometric amount of coal were notably higher, 5.0 and 3.5%, for coarse coke overlayers of 1.0 and 0.75 lb/ft$^2$ (4.88 and 3.77 kg/m$^2$) coverage, respectively. Therefore, again, as previously observed, the generation of micro-nuggets was less at 80% stoichiometric amount of coal in the reducible mixture. It is also noted that the lower coverage by coarse coke overlayer generated less micro-nuggets.

The analytical results are shown in FIG. 21. The results showed that the iron nuggets had undergone substantially complete metallization. It was determined that the iron nuggets analyzed were 0.016 to 0.029% S, while slag analyzed essentially no Fe and 0.23 FeO. The ratio of sulfur in the slag over sulfur in the nuggets by weight, (S)/[S], ranged from 45 to 82.

Figure 25:
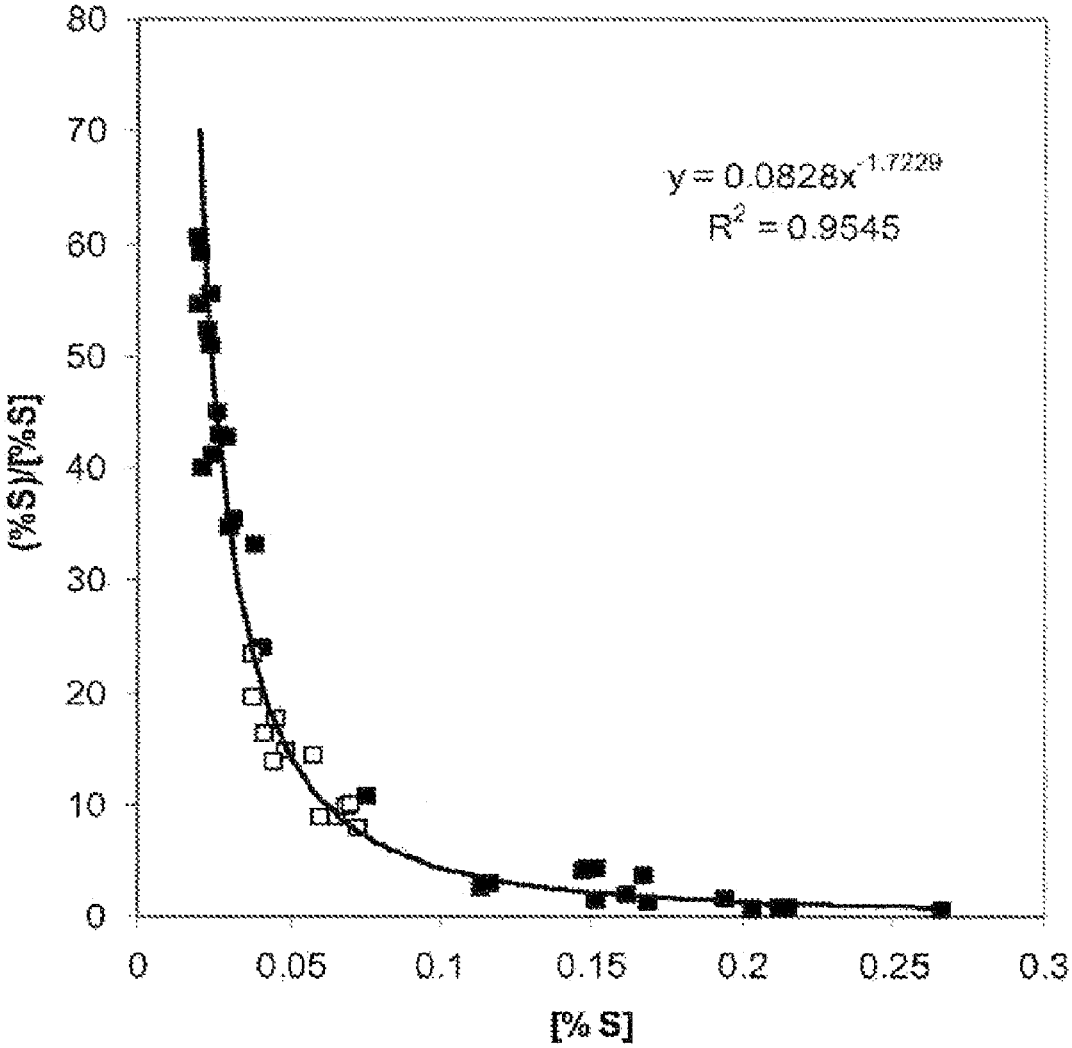
FIG. 25 shows a plot of the ratio of percent sulfur in the slag over percent sulfur in the metallic iron nuggets for tests with and without the addition of the coarse overlayer.
Figure 30:
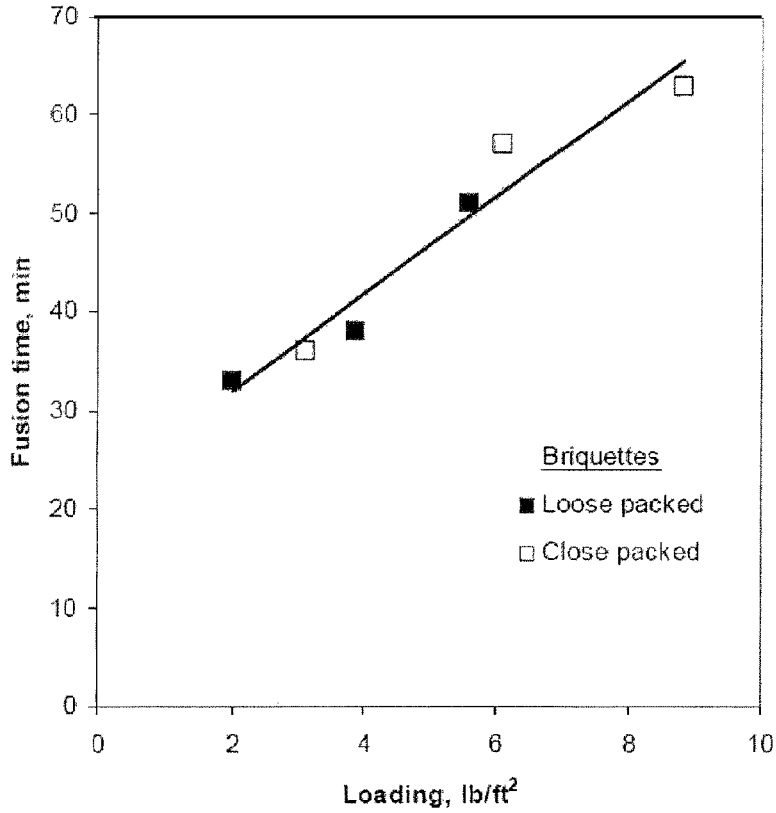
FIG. 30 is a graph illustrating fusion time as affected by the loading of loose-packed and close-packed agglomerates in single, double, and triple layers.
Figure 31:
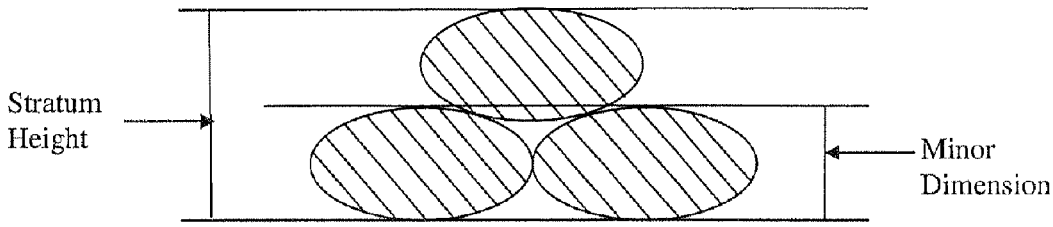
FIG. 31 is a schematic cross-sectional representation illustrating the stacking of multiple layers of closely-packed briquettes forming a stratum.
Figure 32:
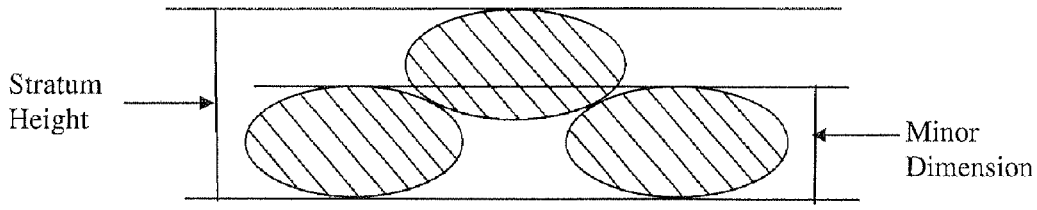
FIG. 32 is a schematic cross-sectional representation illustrating the stacking of multiple layers of loosely-packed briquettes forming a stratum.
Figure 33:
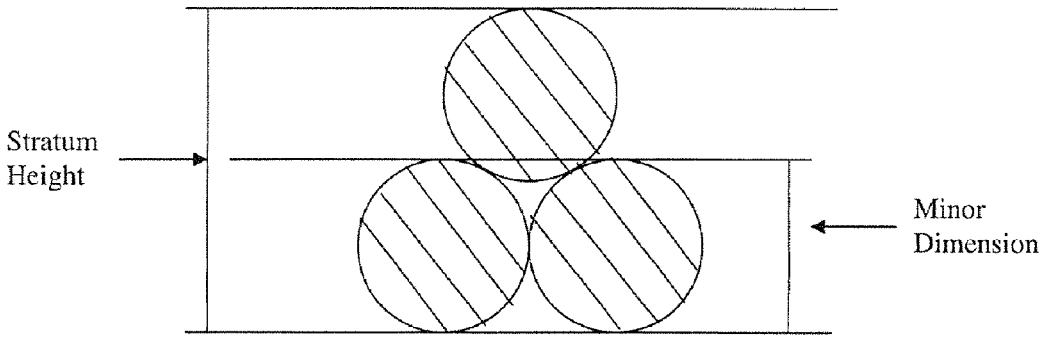
FIG. 33 is a schematic cross-sectional representation illustrating the stacking of multiple layers of closely-packed balls forming a stratum.
Figure 34:
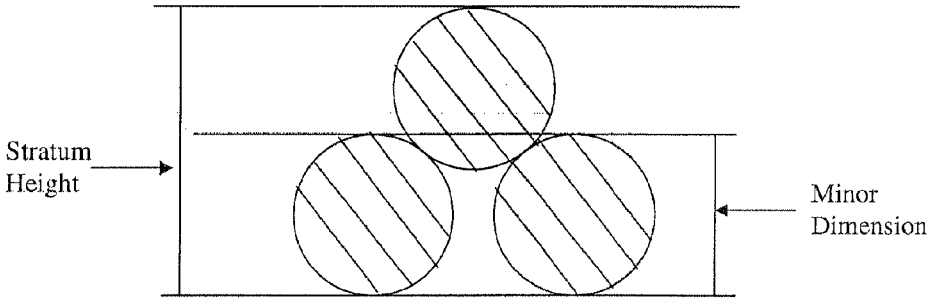
FIG. 34 is a schematic cross-sectional representation illustrating the stacking of multiple layers of loosely-packed balls forming a stratum.
Figure 35:
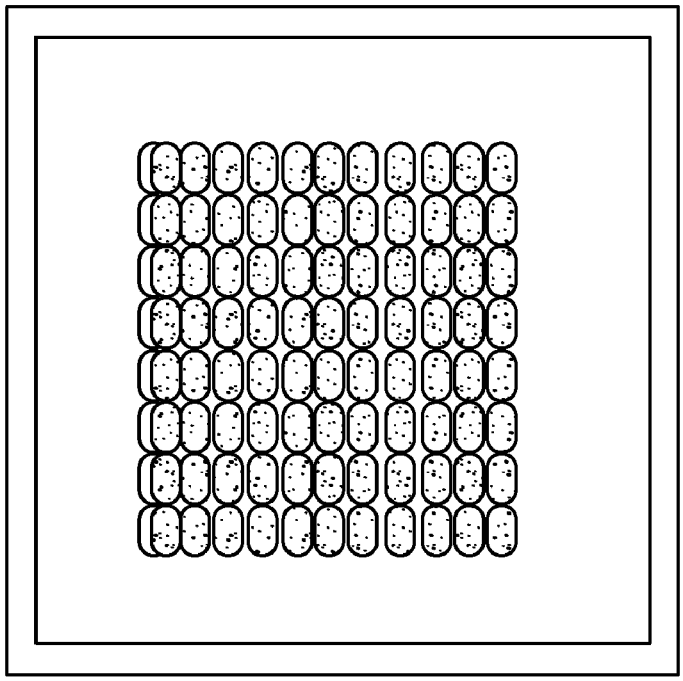
FIG. 35 shows a tray stacked with two layers of briquettes.
Figure 36:
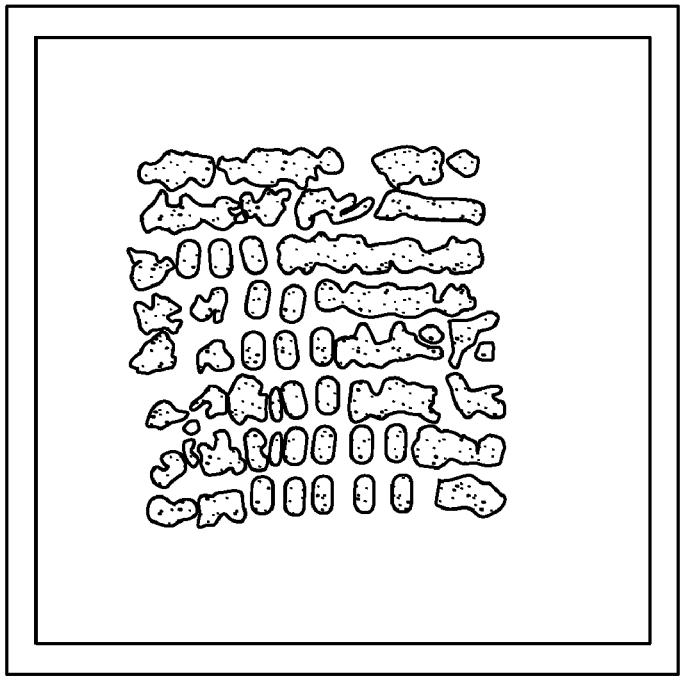
FIG. 36 shows the tray of FIG. 34 after heating the tray with a coarse coke overlayer.
Figure 37:
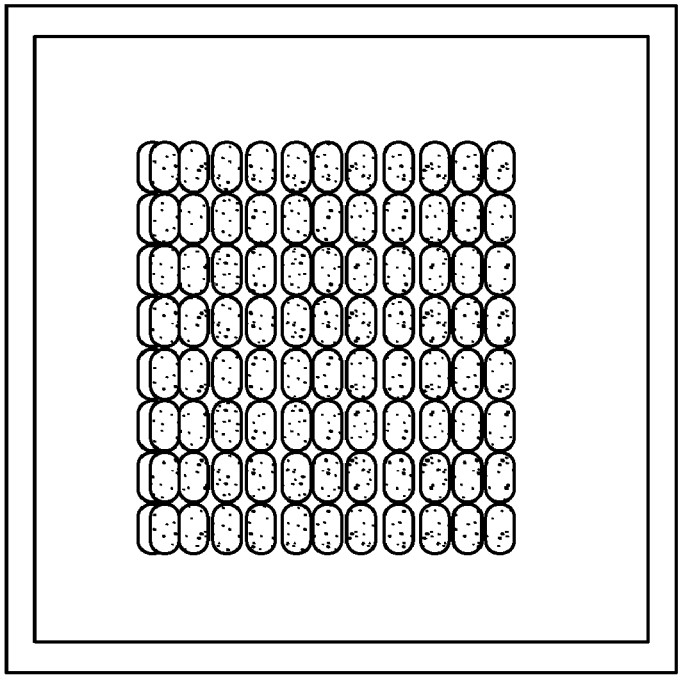
FIG. 37 shows a tray stacked with three layers of briquettes.
Figure 38:
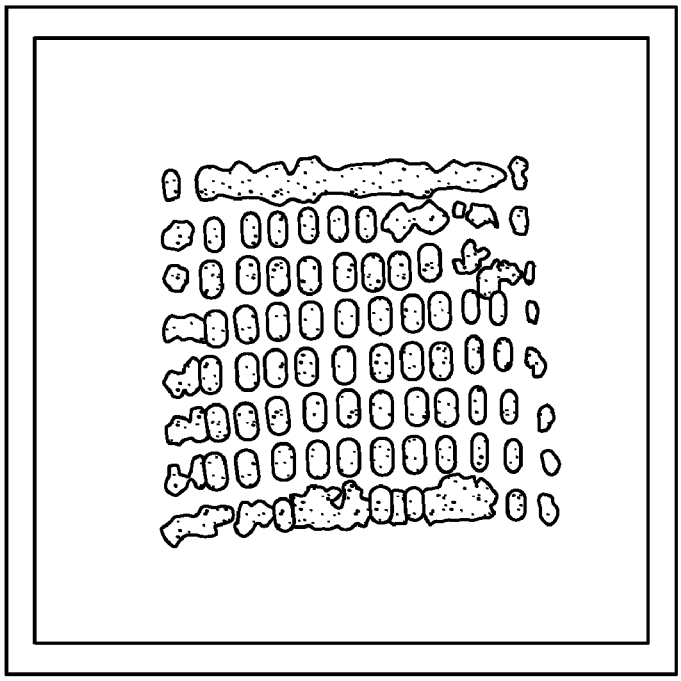
FIG. 38 shows the tray of FIG. 37 after heating the tray with a coarse coke overlayer.

Referring to FIG. 25, the relationship (i.e., the ratio) of sulfur in the slag over sulfur in the metallic nuggets, (S)/[S], is plotted as a function of the percent by weight sulfur in the nuggets for the various tests that have been done. The filled squares (■) are for the LHF tests on reducible feed mixtures using 5.3% $SiO_2$ taconite concentrate, a Slag Composition $L_{1.5}FS_2$, and 80% stoichiometric Fording Standard coal. The open squares (□) are for box furnace tests on reducible feed mixture using 3.6% $SiO_2$ taconite concentrate, a Slag Composition $L_{1.5}FS_2$, and 80% stoichiometric Jim Walter coal.

The data points for ratio (S)/[S] below 12 were for tests without the coarse coke overlayer and the others are for tests with the coarse coke overlayer with no deliberately added Mg producing levels between 5% and 13% of MgO in the slag. As shown by the plotted data in FIG. 25, sulfur is increased in the slag by the use of the coarse carbonaceous overlayer, and that when the ratio (S)/[S] is 30 or more, sulfur content in the metallic iron nuggets that are produced was 0.03% or less. These latter metallic iron nuggets are particularly useful in steelmaking processes such as the electric arc furnace, because the iron nuggets may be substituted for scrap in the charge.

The coarse coke overlayer enabled carburizing both from the hearth layer and the coarse coke overlayer. The availability of carbon from the coarse overlayer is advantageous in lowering the overall processing temperature requirements, while creating the necessary reduction conditions to allow effective separation of sulfur into the slag.

In view of the above, in some embodiments of the present process, the use of a reducible feed mixture that includes a reducible mixture, on the hearth layer, that has a predetermined quantity of reducing material between about 70 percent and about 90 percent of the stoichiometric amount of reducing material and with a coarse carbonaceous material or an overlayer of turbulent gas flow disrupting material over at least a portion of the layer of the reducible mixture results in complete metallization thereof, and also reduce the potential for formation of micro-nuggets. The result was reproduced with the box and tube furnaces. In other words, a sub-stoichiometric amount of reducing material (e.g., coal) may be used with the overlayer to obtain almost complete metallization and formation of metallic iron nuggets from a predetermined quantity of reducible iron bearing material, the reducing material (e.g., coal) and the iron bearing material providing a reducible feed mixture for processing according to one or more embodiments described herein.

One will recognize that various shapes of the compacts preformed may be used, and still maintain the benefit of having a feed mixture with a sub-stoichiometric amount of reducing material (e.g., coal) next to the hearth layer to minimize micro-nugget formation. The configurations of the agglomerates described herein are given for illustration only.

Tests with Multiple Layers of Agglomerates and a Coarse Overlayer

Tests were performed to determine the benefits of use of multiple layers of agglomerates in production of nodular reduced iron ("NRI"). The tests were performed with briquettes as the agglomerate, a hearth material layer, and a coarse overlayer or cover layer. The production of NRI is increased if, for example, the processing time with two layers of agglomerates is less than a one hundred percent (100%) increase over the processing time with a single layer of agglomerates; or if the processing time with three layers of agglomerates is less than a two hundred percent (200%) increase in the time with a single layer of agglomerates.

The hearth material layer and cover layer were initially investigated to determine how the thickness or density of each affects NRI fusion for different agglomerate layering. FIG. 26 is a table that summarizes the fusion time for the NRI in minutes as it relates to numbers of layers of agglomerates, hearth material layer thickness, and cover layer density. As shown in FIG. 26, fusion time for agglomerates increases as the number of layers of agglomerates increases, as the thickness of the hearth material layer increases, and as the density of the cover layer increases.

FIG. 27 details the productivity of NRI fusion, expressed as the ratio of the number of agglomerates in a batch and fusion time in minutes. As illustrated, productivity increased as the number of layers of agglomerates increased, as the thickness of the hearth layer decreased, and as the density of the cover layer decreased. As FIG. 27 shows, productivity increased 10-20% when the cover layer decreased from 1 to 0.75 lb/ft$^2$; 15-20% when the hearth material layer thickness decreased from 1" to ½"; increased 40-50% when agglomerates increased from single to double layers; and 50-60% when agglomerates were increased from single to triple layers in processing. Moreover, productivity increased 100% when the hearth layer thickness decreased from 1" to ½", the cover layer decreased from 1 lb/ft$^2$ to 0.75 lb/ft$^2$, and double and triple layers of agglomerates were used in processing.

Thus, these tests illustrate the benefits to productivity when multiple layers of agglomerates are processed. Furthermore, in some embodiments, it is contemplated that the multiple layers of agglomerates may be positioned on a hearth material layer of at least carbonaceous material and a coarse overlayer of carbonaceous material may be placed over the layers of agglomerates.

In some embodiments, it may be beneficial to refer to the total height of agglomerates as a stratum of agglomerates. A stratum of agglomerates may or may not comprise discrete layers, or may partially comprise one or more discrete layers of agglomerates. If, for example, a plurality of agglomerates were placed on a hearth material layer and some stacking of agglomerates occurred during placement of the agglomerates, the stratum of agglomerates may not fully comprise discrete layers. Nevertheless, such a stratum of agglomerates may effectively increase the productivity of NRI production.

With some agglomerates, the actual height of two closely-packed layers (stratum height) may be approximately 1.8 to 1.9 times the height of a single layer because of partial nesting of the top layer of agglomerates in the interstitial space of the bottom layer. With more loosely packed agglomerates, the height of two layers may be 1.5 to 1.8 times the height of a single layer, and more typically about 1.7 to 1.8 times the height of a single layer.

Therefore, in some embodiments of the disclosed method, a stratum of agglomerates may be utilized where the stratum height is at least 1.7 times the height of a single layer of agglomerates. More particularly, some agglomerates like briquettes or extrusions include a larger major dimension or length and a smaller minor dimension or height. With balls, on the other hand, the major dimension and minor dimension would be the same. An exemplary embodiment of a briquette may have a dimension of 1.33 inches by 0.84 inches by 0.56 inches. Such briquette would have a major dimension of 1.33 inches and a minor dimension of 0.56 inches. It is therefore contemplated that an embodiment of the disclosed method may comprise a stratum of agglomerates where the height of the stratum comprises at least 1.7 times the minor dimension of the individual agglomerates.

Further tests were also performed on how close-packing of agglomerates affects fusion time versus loose-packing of agglomerates. FIGS. 31-34 illustrate schematically cross-sections of agglomerates and balls closely-packed and loosely-packed. The tests were also performed on briquettes as the agglomerate, with a hearth material layer and a coarse overlayer or cover layer. As illustrated in FIG. 28, as the agglomerates became more densely-packed in a given layer, gross fusion time increased but productivity increased. Similarly, as the number of layers increased, gross fusion time increased but productivity increased. In other words, processing rates of agglomerates, expressed as the ratio of loading and fusion time in lb/ft$^2$/hr, increased as the number of layers increased and as the loading density or density ("loading density") of the agglomerates increased. The processing rates were highest (8.4 lb/ft$^2$/hr) in closely packed agglomerates in three layers—233% higher than loosely-packed agglomerates in one layer.

Accordingly, in some embodiments of the disclosed method, the agglomerates may be positioned in one or more layers where the loading density of the layer(s) is at least 2.5 lb/ft$^2$/layer, at least 2.8 lb/ft$^2$/layer, or 3 lb/ft$^2$/layer or greater.

This invention has been described with reference to illustrative embodiments and is not meant to be construed in a limiting sense. It will be apparent to one skilled in the art that elements or process steps from one or more embodiments described herein may be used in combination with elements or process steps from one or more other embodiments described herein, and that the present invention is not limited to the specific embodiments provided herein but only as set forth in the accompanying claims. Various modifications of the illustrative embodiments, as well as additional embodiments to the invention will be apparent to persons skilled in the art upon reference to this description.

What is claimed is:

1. A method of producing metallic iron nuggets comprising the steps of:

providing a hearth comprising refractory material, positioning a hearth material layer comprising at least carbonaceous material on the refractory material, positioning on the hearth material layer multiple layers of agglomerates comprising reducing material and reducible iron bearing material where the multiple layers comprise at least two layers of agglomerates and where a loading density of the agglomerates is at least 2.5 $lb/ft^2$/layer, and heating the agglomerates to form from at least some of the agglomerates metallic iron nuggets and slag.

2. The method of producing metallic iron nuggets as claimed in claim 1 where the multiple layers comprise at least three layers of agglomerates.

3. The method of producing metallic iron nuggets as claimed in claim 1 where the multiple layers comprise at least four layers of agglomerates.

4. The method of producing metallic iron nuggets as claimed in claim 1 where the agglomerates are selected from at least one of the group consisting of briquettes, extrusions and balls.

5. The method of producing metallic iron nuggets as claimed in claim 1 where the multiple layers comprise at least two layers of agglomerates, and where a loading density of the agglomerates is at least 2.9 $lb/ft^2$/layer.

6. The method of producing metallic iron nuggets as claimed in claim 1 further comprising the step of providing an overlayer of coarse carbonaceous material over at least a portion of the agglomerates.

7. The method of producing metallic iron nuggets as claimed in claim 6 where the multiple layers comprise at least three layers of agglomerates.

8. The method of producing metallic iron nuggets as claimed in claim 6 where the multiple layers comprise at least four layers of agglomerates.

9. The method of producing metallic iron nuggets as claimed in claim 6 where the agglomerates are selected from at least one of the group consisting of briquettes, extrusions and balls.

10. The method of producing metallic iron nuggets as claimed in claim 6 where the multiple layers comprise at least two layers of agglomerates, and where a loading density of the agglomerates is at least 2.9 $lb/ft^2$/layer.

11. The method of producing metallic iron nuggets as claimed in claim 6 where the hearth material layer comprises a mixture of non-coking coal and a material selected from the group consisting of coke, char and other carbonaceous material.

12. The method of producing metallic iron nuggets as claimed in claim 11 where the non-coking coal is less than 75% of the hearth material layer.

13. The method of producing metallic iron nuggets as claimed in claim 11 where the non-coking coal is less than 50% of the hearth material layer.

14. The method of producing metallic iron nuggets as claimed in claim 11 where the non-coking coal is less than 25% of the hearth material layer.

15. The method of producing metallic iron nuggets as claimed in claim 11 where the non-coking coal is sub-bituminous coal.

16. The method of producing metallic iron nuggets as claimed in claim 15 where the sub-bituminous coal is Powder River Basin coal.

17. The method of producing metallic iron nuggets as claimed in claim 11 where the multiple layers comprise at least three layers of agglomerates.

18. The method of producing metallic iron nuggets as claimed in claim 11 where the multiple layers comprise at least four layers of agglomerates.

19. The method of producing metallic iron nuggets as claimed in claim 11 where the agglomerates are selected from at least one of the group consisting of briquettes, extrusions and balls.

20. The method of producing metallic iron nuggets as claimed in claim 11 where the multiple layers comprise at least two layers of agglomerates, and where a loading density of the agglomerates is at least 2.9 $lb/ft^2$/layer.

21. The method of producing metallic iron nuggets as claimed in claim 6 where the hearth material layer comprises a mixture of non-caking coal and a material selected from the group consisting of coke, char and other carbonaceous material.

22. The method of producing metallic iron nuggets as claimed in claim 21 where the non-caking coal is less than 75% of the hearth material layer.

23. The method of producing metallic iron nuggets as claimed in claim 21 where the non-caking coal is less than 50% of the hearth material layer.

24. The method of producing metallic iron nuggets as claimed in claim 21 where the non-caking coal is less than 25% of the hearth material layer.

25. The method of producing metallic iron nuggets as claimed in claim 21 where the multiple layers comprise at least three layers of agglomerates.

26. The method of producing metallic iron nuggets as claimed in claim 21 where the multiple layers comprise at least four layers of agglomerates.

27. The method of producing metallic iron nuggets as claimed in claim 21 where the agglomerates are selected from at least one of the group consisting of briquettes, extrusions and balls.

28. The method of producing metallic iron nuggets as claimed in claim 21 where the multiple layers comprise at least two layers of agglomerates, and where a loading density of the agglomerates is at least 2.9 $lb/ft^2$/layer.

29. The method of producing metallic iron nuggets as claimed in claim 1 where the hearth material layer comprises a mixture of non-coking coal and a material selected from the group consisting of coke, char and other carbonaceous material.

30. The method of producing metallic iron nuggets as claimed in claim 29 where the non-coking coal is less than 75% of the hearth material layer.

31. The method of producing metallic iron nuggets as claimed in claim 29 where the non-coking coal is less than 50% of the hearth material layer.

32. The method of producing metallic iron nuggets as claimed in claim 29 where the non-coking coal is less than 25% of the hearth material layer.

33. The method of producing metallic iron nuggets as claimed in claim 29 where the non-coking coal is sub-bituminous coal.

34. The method of producing metallic iron nuggets as claimed in claim 33 where the sub-bituminous coal is Powder River Basin coal.

35. The method of producing metallic iron nuggets as claimed in claim 29 where the multiple layers comprise at least three layers of agglomerates.

36. The method of producing metallic iron nuggets as claimed in claim 29 where the multiple layers comprise at least four layers of agglomerates.

37. The method of producing metallic iron nuggets as claimed in claim 29 where the agglomerates are selected from at least one of the group consisting of briquettes, extrusions and balls.

38. The method of producing metallic iron nuggets as claimed in claim 29 where the multiple layers comprise at least two layers of agglomerates, and where a loading density of the agglomerates is at least 2.9 $lb/ft^2$/layer.

39. The method of producing metallic iron nuggets as claimed in claim 1 where the hearth material layer comprises a mixture of non-caking coal and a material selected from the group consisting of coke, char and other carbonaceous material.

40. The method of producing metallic iron nuggets as claimed in claim 39 where the non-caking coal is less than 75% of the hearth material layer.

41. The method of producing metallic iron nuggets as claimed in claim 39 where the non-caking coal is less than 50% of the hearth material layer.

42. The method of producing metallic iron nuggets as claimed in claim 39 where the non-caking coal is less than 25% of the hearth material layer.

43. The method of producing metallic iron nuggets as claimed in claim 39 where the multiple layers comprise at least three layers of agglomerates.

44. The method of producing metallic iron nuggets as claimed in claim 39 where there are four layers of agglomerates.

45. The method of producing metallic iron nuggets as claimed in claim 39 where the agglomerates are selected from at least one of the group consisting of briquettes, extrusions and balls.

46. The method of producing metallic iron nuggets as claimed in claim 39 where the multiple layers comprise at least two layers of aggomerates, and where a loading density of the agglomerates is at least 2.9 $lb/ft^2$/layer.

47. A method of producing metallic iron nuggets comprising the steps of:

providing a hearth comprising refractory material, positioning a hearth material layer comprising at least carbonaceous material on the refractory material, positioning at least two layers of agglomerates comprised of reducing material and reducible iron bearing material on the hearth material layer, and heating the agglomerates to form from at least some of the agglomerates metallic iron nuggets and slag.

48. The method of producing metallic iron nuggets as claimed in claim 47 where there are two layers of agglomerates.

49. The method of producing metallic iron nuggets as claimed in claim 48 where there are three layers of agglomerates.

50. The method of producing metallic iron nuggets as claimed in claim 48 where there are four layers of agglomerates.

51. The method of producing metallic iron nuggets as claimed in claim 48 where the agglomerates are selected from at least one of the group consisting of briquettes, extrusions and balls.

52. The method of producing metallic iron nuggets as claimed in claim 48 where a loading density of the agglomerates is at least 2.5 $lb/ft^2$/layer.

53. The method of producing metallic iron nuggets as claimed in claim 48 where a loading density of the agglomerates is at least 2.9 $lb/ft^2$/layer.

54. The method of producing metallic iron nuggets as claimed in claim 48 further comprising the step of providing an overlayer of coarse carbonaceous material over at least a portion of the agglomerates.

55. The method of producing metallic iron nuggets as claimed in claim 54 where the overlayer of coarse material has a loading density of approximately 0.75 $lb/ft^2$.

56. The method of producing metallic iron nuggets as claimed in claim 54 where the hearth material layer comprises a mixture of non-coking coal and a material selected from the group consisting of coke, char and other carbonaceous material.

57. The method of producing metallic iron nuggets as claimed in claim 48 where the hearth material layer comprises a mixture of non-coking coal and a material selected from the group consisting of coke, char and other carbonaceous material.

58. The method of producing metallic iron nuggets as claimed in claim 57 where the non-coking coal is less than 75% of the hearth material layer.

59. The method of producing metallic iron nuggets as claimed in claim 57 where the non-coking coal is less than 50% of the hearth material layer.

60. The method of producing metallic iron nuggets as claimed in claim 57 where the non-coking coal is less than 25% of the hearth material layer.

61. The method of producing metallic iron nuggets as claimed in claim 57 where the non-coking coal is sub-bituminous coal.

62. The method of producing metallic iron nuggets as claimed in claim 61 where the sub-bituminous coal is Powder River Basin coal.

63. The method of producing metallic iron nuggets as claimed in claim 47 where the hearth material layer comprises a mixture of non-caking coal and a material selected from the group consisting of coke, char and other carbonaceous material.

64. The method of producing metallic iron nuggets as claimed in claim 63 where the non-caking coal is less than 75% of the hearth material layer.

65. The method of producing metallic iron nuggets as claimed in claim 63 where the non-caking coal is less than 50% of the hearth material layer.

66. The method of producing metallic iron nuggets as claimed in claim 63 where the non-caking coal is less than 25% of the hearth material layer.

67. A method of producing metallic iron nuggets comprising the steps of:

providing a hearth comprising refractory material, positioning a hearth material layer comprising a mixture of Powder River Basin coal and a material selected from the group consisting of coke, char and other carbonaceous material, positioning on the hearth material layer multiple layers of agglomerates comprising reducing material and reducible iron bearing material and having a minor dimension, where adjacent layers have an average depth of at least 1.75 times the minor dimension of one of the layers, providing an overlayer of coarse carbonaceous material over at least a portion of the agglomerates, and heating the agglomerates to form from at least some of the agglomerates metallic iron nuggets and slag.

68. The method of producing metallic iron nuggets as claimed in claim 67 where the multiple layers comprise at least two layers of agglomerates.

69. The method of producing metallic iron nuggets as claimed in claim 67 where the multiple layers comprise at least three layers of agglomerates.

70. The method of producing metallic iron nuggets as claimed in claim 67 where the multiple layers comprise at least four layers of agglomerates.

71. The method of producing metallic iron nuggets as claimed in claim 67 where the agglomerates are selected from at least one of the group consisting of briquettes, extrusions and balls.

72. The method of producing metallic iron nuggets as claimed in claim 67 where the multiple layers comprise at least two layers of agglomerates, and where a loading density of the agglomerates is at least 2.5 $lb/ft^2$/layer.

73. The method of producing metallic iron nuggets as claimed in claim 67 where the multiple layers comprise at least two layers of agglomerates, and where a loading density of the agglomerates is at least 2.9 $lb/ft^2$/layer.

74. The method of producing metallic iron nuggets as claimed in claim 67 where the overlayer of coarse material has a density of approximately 0.75 $lb/ft^2$.

* * * * *

UNITED STATES PATENT AND TRADEMARK OFFICE

CERTIFICATE OF CORRECTION

PATENT NO. : 8,333,823 B2
APPLICATION NO. : 12/847591
DATED : December 18, 2012
INVENTOR(S) : Iwao Iwasaki et al.

It is certified that error appears in the above-identified patent and that said Letters Patent is hereby corrected as shown below:

In the Specification:
Column 1, lines 15-19
delete "The present invention was made with support by the Economic Development Administration, Grant No. 06-69-04501, and the Department of Energy, Sponsor Award DE-FG36-05GO15185. The United States government may have certain rights in the invention."
insert -- This invention was made with government support under Sponsor Award DE-FG36-05GO15185 awarded by the Department of Energy, and Grant No. 06-69-04501 awarded by the Economic Development Administration. The government has certain rights in the invention. --

Signed and Sealed this
Seventeenth Day of June, 2014

Michelle K. Lee

Michelle K. Lee
*Deputy Director of the United States Patent and Trademark Office*